US007901025B2

(12) United States Patent
Kato et al.

(10) Patent No.: US 7,901,025 B2
(45) Date of Patent: Mar. 8, 2011

(54) INK-JET PRINTING APPARATUS AND INK-JET PRINTING METHOD

(75) Inventors: Ryota Kato, Yokohama (JP); Yoshitomo Marumoto, Yokohama (JP); Hitoshi Tsuboi, Kawasaki (JP); Eri Noguchi, Yokohama (JP); Takeshi Egami, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/606,835

(22) Filed: Oct. 27, 2009

(65) Prior Publication Data

US 2010/0045723 A1 Feb. 25, 2010

Related U.S. Application Data

(63) Continuation of application No. PCT/JP2009/061422, filed on Jun. 23, 2009.

(30) Foreign Application Priority Data

Jun. 25, 2008 (JP) ..... 2008-166181

(51) Int. Cl.
*B41J 2/205* (2006.01)

(52) U.S. Cl. ..... 347/15; 347/41; 347/43

(58) Field of Classification Search ..... 347/912, 347/15, 40, 41, 43, 44, 57, 95, 100
See application file for complete search history.

(56) References Cited

U.S. PATENT DOCUMENTS

| | | | | |
|---|---|---|---|---|
| 6,474,777 | B1 * | 11/2002 | Fujita et al. | 347/41 |
| 6,517,178 | B1 * | 2/2003 | Yamamoto et al. | 347/15 |
| 6,840,596 | B2 * | 1/2005 | Moto et al. | 347/14 |
| 2005/0057604 | A1 | 3/2005 | Ogasawara | |
| 2006/0279596 | A1 | 12/2006 | Furuichi et al. | |
| 2008/0137146 | A1 | 6/2008 | Marumoto | |

FOREIGN PATENT DOCUMENTS

| | | |
|---|---|---|
| JP | 10-044473 | 2/1998 |
| JP | 2000-229424 | 8/2000 |
| JP | 2005-88208 | 4/2005 |
| JP | 2007-15376 | 1/2007 |
| JP | 4273175 | 3/2009 |

* cited by examiner

*Primary Examiner* — Thinh H Nguyen
(74) *Attorney, Agent, or Firm* — Fitzpatrick, Cella, Harper & Scinto

(57) ABSTRACT

The print permitting ratios of the masks in the first to fourth passes of a C ink are respectively 6.2%, 37.5%, 37.5%, and 18.8%. On the other hand, the print permitting ratios of the masks in the first to fourth passes of an M ink are respectively 12.5%, 37.5%, 37.5%, and 12.5%. In this way, the respective masks are set such that a larger amount of the C ink is applied in a later pass as compared with the M ink. Thereby, it is possible to reduce an amount of the M ink to be applied later with respect to the C ink functioning to "reduce a permeation speed of an ink applied later by filling," and it is possible to prevent a permeation speed from slowing down overall. As a result, it is possible to prevent the occurrence of beading due to a time to complete permeation becoming longer.

9 Claims, 23 Drawing Sheets

INK-JET PRINTING APPARATUS AND INK-JET PRINTING METHOD

BACKGROUND OF THE INVENTION

1. Field of the Invention

The present invention relates to an ink-jet printing apparatus and an ink-jet printing method, and in particular, to a configuration thereof to reduce a granular feeling in a printed image by an ink ejection control.

2. Description of the Related Art

In accordance with the popularization of information processing apparatus such as personal computers in recent years, printing apparatuses as image forming terminals have been rapidly developed and popularized. Among various printing apparatuses, ink-jet printing apparatuses that perform printing by ejecting inks onto a printing medium such as a paper have various advantages, and have become a mainstream in personal use. The ink-jet printing apparatuses are required to be further improved in an image quality with such extensive popularization, and for example, a quality level of an image corresponding to silver halide photography is required for the ink-jet printing apparatuses as a print system capable of printing photography easily at home. In ink-jet printing apparatuses, there has been conventionally a problem of a granular feeling in a printed image as compared with silver halide photography.

Various countermeasures for the granular feeling have been proposed. For example, ink-jet printing apparatuses having an ink system in which light cyan and light magenta inks with lower concentrations of color materials are added in addition to normal cyan, magenta, yellow and black inks, have been known. Specifically, by using such an ink system, it is possible to reduce the granular feeling by using light cyan and light magenta inks on an area of lower print density. Then, by performing printing on an area of higher print density by use of the normal cyan and magenta inks, it is also possible to realize a broader color reproducibility and smoother gradient.

Further, there is also a method for reducing the granular feeling by designing a printing apparatus so as to make dots formed with inks on a printing medium smaller in size. This is a method for reducing the volume of an ink droplet to be ejected from ejection openings of a printing head. In this case, not only are the volume of ink droplet reduced, but also a greater number of ejection openings are arrayed at a higher degree of density, which makes it possible to simultaneously obtain a high resolution image without degrading its printing speed.

As factors to emphasize the granular feeling, there are not only the above described high concentration of color material in ink and sizes of ink dots to be formed, but also bleeding and beading of ink. Since there is a limit to an amount of ink absorbed by a printing medium, for example, when inks in an amount greater than the limit are ejected onto a given area of the printing medium, ink bleeding occurs, which may appear as a granular feeling in some cases. In particular, in a case in which two or more color inks are ejected so as to be overlapped on one another in one pixel, ink bleeding due to an amount of inks being greater than a limit to an ink absorbing amount easily occurs. For example, in an apparatus using four color inks of cyan, magenta, yellow and black, in a case in which secondary colors which are red, blue and green are expressed, an ink amount to be ejected per one pixel is made greater than that in a case in which primary colors which are yellow, magenta and cyan are expressed. Further, in such a case, beading serving as a phenomenon in which a plurality of ink droplets are not absorbed exist as liquid on a paper surface, and those droplets attract each other to become greater droplets, to finally form dots greater than the original dots may be caused.

In order to suppress a worsening in a granular feeling due to these bleeding and beading, the following method has been proposed. By performing so-called multipass printing, it is possible to reduce an ink amount to be applied to a unit area on a printing medium per one scanning or unit time. Thereby, it is possible to reduce ink bleeding on a printing medium, or beading due to ink droplets being not able to be absorbed to contact with each other in a liquid state on the printing medium.

Further, as another method for reducing an ink amount to be applied to a unit area per unit time, there is disclosed in Japanese Patent Laid-Open No. H10-44473 (1998) that uses not only yellow, magenta, cyan, and black inks, but also inks of secondary colors of red, blue, and green. Specifically, at the time of printing the secondary colors of red, blue, and green, it is possible to reduce an ink amount to be applied to one pixel by respectively using the inks of red, blue, and green.

Moreover, there is disclosed in Japanese Patent Laid-Open No. 2000-229424 that a limit where the maximum ejection amounts of the respective color inks at the time of printing secondary colors are less than or equal to 100% is provided, and printing is performed by use of two colors of the primary color inks and secondary color inks.

However, in a multi-pass printing system, when the number of passes is increased in order to reduce an ink amount to be applied to a unit area on a printing medium per unit time, this may be a cause for bringing about an increase in a time required for printing, which prevents throughput enhancement and speeding up of printing. In contrast thereto, the methods disclosed in Japanese Patent Laid-Open No. H10-44473 (1998) and Japanese Patent Laid-Open No. 2000-229424 are used in place of the mode in which the number of passes is increased, to be able to reduce an ink amount to be applied per unit area. However, in a case that the number of passes for the multi-pass printing is small even if the methods disclosed in Japanese Patent Laid-Open No. H10-44473 (1998) and Japanese Patent Laid-Open No. 2000-229424 are used, the greater applying amount per one pass due to smaller number of passes may far more affect degradation in image quality than reducing applying amount of ink per a unit area by use of the secondary color of inks. Then, in such a situation, even if all the inks finally provided thereto are able to be absorbed, it may be insufficient for a printing medium to absorb inks applied in the middle of completing an image.

On the other hand, in accordance with the study of the inventors of the present application, it has been confirmed that an ink applied to a region on which an ink has already landed takes time to complete its permeation longer than that of the ink first applied to a printing medium, which easily causes beading.

FIGS. 1A and 1B and FIGS. 2A to 2F are diagrams for explaining this phenomenon.

FIGS. 1A and 1B show a state in which ink first is applied to places on a printing medium on which ink has not applied. Specifically, FIGS. 1A and 1B show a state in which a cyan pigment ink is applied to the printing medium that is a so-called glossy paper. When the cyan pigment ink 101 is applied to a printing medium 102 (FIG. 1A), a water component and a solvent of the ink permeate the printing medium and evaporate at the same time, and a solid content 103 of the pigment ink fixates to the printing medium 102 (FIG. 1B).

On the other hand, FIGS. 2A to 2F show a state in which ink is applied to a printing medium that is a glossy paper and the ink fixates thereto and other ink further is applied to the fixation place and fixates thereto. When a cyan ink 201 in a sufficient amount to cover the surface thereof is applied to a printing medium 202 (FIG. 2A), a cyan ink layer 203 is formed thereon (FIG. 2B). Then, next, when a magenta ink 204 is applied to the printing medium (FIG. 2C), a time to complete permeation of ink droplets 205 applied to the cyan ink layer 203 is made longer than that of ink droplets 206 applied to a place on which there is no ink layer (FIG. 2D). As a result, when a yellow ink 207 is applied to a place respectively adjacent to the ink droplets 205 and 206 (FIG. 2D), since the ink droplets 205 have not sufficiently permeated yet, the ink droplets 205 and the ink 207 bring about beading 208 (FIG. 2E). Then, an ink layer 210 due to the beading is formed thereon (FIG. 2F). On the other hand, since the liquid component of the ink droplets 206 has sufficiently permeated, the ink droplets 206 and the ink 207 applied later are not coupled together (FIG. 2E), and ink layers 211 in a separated state is finally formed (FIG. 2F). The ink layer 210 due to beading formed as described above appears as a granular feeling in a printed image, which brings about degradation in its image quality level. The reason for that there is a difference in the times to complete their permeation, may be that ink layers have pore structures which are densely filled more than that of a printing medium. Note that, in the description with reference to FIGS. 2A to 2F, the example in which the ink is applied to a position adjacent to the inks applied in sequence (the relationship between the ink droplets 205 and the ink 207 in FIG. 2D) has been described. However, as a matter of course, the problem of permeation speeds is not necessarily caused in only this example. In a case in which an ink ejected in certain timing is applied to the same position of an ink ejected in the previous timing to be overlapped thereon, the same problem of permeation speeds is caused. Further, in contrast thereto, even in a case that pixels to which inks are applied are not adjacent to one another, the same problem is caused in a case in which inks are applied in sequence at a distance at which the inks may contact with each other in accordance with sizes of applied ink droplets.

Moreover, in accordance with further study by the inventors, it has been made clear that, in a case that an ink is applied to a place on which an ink has already landed, times to complete their permeation differ in accordance with ink properties of inks applied in sequence. Specifically, when two or more types of inks are used, an order of overlapping the inks differs in accordance with an order of ejecting these inks, which generates a difference in times to complete overall permeation according to those orders. When the time to complete permeation is long, beading may occur.

Various reasons for that a permeation speed with respect to an ink layer differs in accordance with a type of ink, are possible. However, a filling rate for a pore structure formed by an ink solid content on a printing medium can be cited as a major factor. For example, in a case in which a pigment and resin are included in an ink, its pore structure is formed such that the resin fills among pigment particles on a printing medium. Then, a permeation speed with respect to an ink layer differs in accordance with a remaining ratio of pores which are not filled (hereinafter called a "P/B value" as well) in these pore structures. That is, the greater the P/B value is, the more the filled structure of an ink layer is sparse, and therefore, permeation of an ink to subsequently be applied is made faster.

Further, it has been known that carbon black generally used as a black pigment forms a grape cluster like structure in which primary particles fuse to attach to each other. In a case that carbon black is included in a color material of ink, a permeation speed with respect to an ink layer differs in accordance with differences of that structure as well. Here, a level of a size of a structure is denoted by DBP oil absorption amount, and the DBP oil absorption amount means a value measured in accordance with the JIS K6221 A. Specifically, an ink with high DBP oil absorption amount forms a high ink layer at the time of forming an ink layer, and a permeation speed of an ink to be applied next is made faster. On the other hand, an ink with low DBP oil absorption amount forms a highly-dense ink layer at the time of forming an ink layer, and a permeation speed of an ink to subsequently be applied is made slower.

SUMMARY OF THE INVENTION

An object of the present invention is to reduce degradation in image quality due to beading or the like caused by different types of inks contacting with each other.

In the first aspect of the present invention, there is provided an ink jet printing apparatus that performs a relative movement of a first ejection portion for ejecting first ink and a second ejection portion for ejecting second ink which is different type of ink from the first ink to a printing medium, and causes the first and second ejection portions to eject the first and second inks to print an image on the printing medium during the relative movement, wherein a permeation speed of the first ink in a case that the first ink is ejected on the second ink that has been ejected onto the printing medium is slower than a permeation speed of the second ink in a case that the second ink is ejected on the first ink that has been ejected onto the printing medium, and ejection timings of the first and second ink from the first and second ejection portions are controlled so that a percentage of pixels to which the second ink is ejected after the first ink is ejected is higher than a percentage of pixels to which the first ink is ejected after the second ink is ejected.

In the second aspect of the present invention, there is provided an ink jet printing apparatus that performs printing onto a printing medium by using a first ejection portion for ejecting first ink and a second ejection portion for ejecting second ink which is different type of ink from the first ink, said apparatus comprising: a moving unit configured to perform a relative movement of the first and second ejection portions to the printing medium; a dividing unit configured to divide first image data to be printed on a predetermined area of the printing medium by using the first ejection portion into first divided image data groups corresponding to a plurality of relative movements and divide second image data to be printed on the predetermined area by using the second ejection portion into second divided image data groups corresponding to the plurality of relative movements; and an ejection controlling unit configured to cause the first ejection portion to eject the first ink according to the first divided image data groups and cause the second ejection portion to eject the second ink according to the second divided image data groups, during the plurality of relative movements for the predetermined area, wherein a permeation speed of the first ink in a case that the first ink is ejected on the second ink that has been ejected onto the printing medium is slower than a permeation speed of the second ink in a case that the second ink is ejected on the first ink that has been ejected onto the printing medium, and the dividing unit divides the first and second image data so that a percentage of pixels to which the second ink is ejected after the first ink is ejected is higher than a percentage of pixels to which the first ink is ejected after the second ink is ejected.

In the third aspect of the present invention, there is provided an ink jet printing apparatus that performs printing onto a printing medium by using a first ejection portion for ejecting first ink and a second ejection portion for ejecting second ink which is different type of ink from the first ink, said apparatus comprising: a moving unit configured to perform a relative movement of the first and second ejection portions to the printing medium; a dividing unit configured to divide first image data to be printed on a predetermined area of the printing medium with use of the first ejection portion into first divided image data groups corresponding to a plurality of relative movements by using a first mask having print permitting ratios corresponding to the plurality of relative movements and divide second image data to be printed on the predetermined area with use of the second ejection portion into second divided image data groups corresponding to the plurality of relative movements by using a second mask having print permitting ratios corresponding to the plurality of relative movements; and an ejection controlling unit configured to cause the first ejection portion to eject the first ink according to the first divided image data groups and cause the second ejection portion to eject the second ink according to the second divided image data groups, during the plurality of times of the relative movement for the predetermined area, wherein a permeation speed of the first ink in a case that the first ink is ejected on the second ink that has been ejected onto the printing medium is slower than a permeation speed of the second ink in a case that the second ink is ejected on the first ink that has been ejected onto the printing medium, and the print permitting ratio corresponding to a last half of the plurality of relative movements, in the second mask, is higher than the print permitting ratio corresponding to a last half of the plurality of relative movements, in the first mask.

In the fourth aspect of the present invention, there is provided an ink jet printing apparatus that performs printing onto a printing medium by using a first ejection portion for ejecting first ink and a second ejection portion for ejecting second ink which is different type of ink from the first ink, said apparatus comprising: a moving unit configured to perform a relative movement of the first and second ejection portions to the printing medium; a dividing unit configured to divide first image data to be printed on a predetermined area of the printing medium with use of the first ejection portion into first divided image data groups corresponding to a plurality of relative movements by using a first mask having print permitting ratios corresponding to the plurality of relative movements and divide second image data to be printed on the predetermined area with use of the second ejection portion into second divided image data groups corresponding to the plurality of relative movements by using a second mask having print permitting ratios corresponding to the plurality of relative movements; and an ejection controlling unit configured to cause the first ejection portion to eject the first ink according to the first divided image data groups and cause the second ejection portion to eject the second ink according to the second divided image data groups, during the plurality of the relative movement for the predetermined area, wherein a permeation speed of the first ink in a case that the first ink is ejected on the second ink that has been ejected onto the printing medium is slower than a permeation speed of the second ink in a case that the second ink is ejected on the first ink that has been ejected onto the printing medium, and the print permitting ratio corresponding to the last relative movement of the plurality of relative movements, in the second mask, is higher than the print permitting ratio corresponding to the last relative movement of the plurality of relative movements, in the first mask.

In the fifth aspect of the present invention, there is provided an ink jet printing method of performing a relative movement of a first ejection portion for ejecting first ink and a second ejection portion for ejecting second ink which is different type of ink from the first ink to a printing medium, and causes the first and second ejection portions to eject the first and second inks to print an image on the printing medium during the relative movement, wherein a permeation speed of the first ink in a case that the first ink is ejected on the second ink that has been ejected onto the printing medium is slower than a permeation speed of the second ink in a case that the second ink is ejected on the first ink that has been ejected onto the printing medium, and ejection timings of the first and second ink from the first and second ejection portions are controlled so that a percentage of pixel regions to which the second ink is ejected after the first ink is ejected is higher than a percentage of pixel regions to which the first ink is ejected after the second ink is ejected.

In the sixth aspect of the present invention, there is provided an ink jet printing method of performing printing onto a printing medium by using a first ejection portion for ejecting first ink and a second ejection portion for ejecting second ink which is different type of ink from the first ink, said method comprising: performing a relative movement of the first and second ejection portions to the printing medium; dividing first image data to be printed on a predetermined area of the printing medium by using the first ejection portion into first divided image data groups corresponding to a plurality of relative movements and dividing second image data to be printed on the predetermined area by using the second ejection portion into second divided image data groups corresponding to the plurality of relative movements; and causing the first ejection portion to eject the first ink according to the first divided imaged at a groups and causing the second ejection portion to eject the second ink according to the second divided image data groups, during the plurality of relative movements for the predetermined area, wherein a permeation speed of the first ink in a case that the first ink is ejected on the second ink that has been ejected onto the printing medium is slower than a permeation speed of the second ink in a case that the second ink is ejected on the first ink that has been ejected onto the printing medium, and the first and second image data are divided so that a percentage of pixels to which the second ink is ejected after the first ink is ejected is higher than a percentage of pixels to which the first ink is ejected after the second ink is ejected.

In the seventh aspect of the present invention, there is provided an ink jet printing method of performing printing onto a printing medium by using a first ejection portion for ejecting first ink and a second ejection portion for ejecting second ink which is different type of ink from the first ink, said method comprising: performing a relative movement of the first and second ejection portions to the printing medium; dividing first image data to be printed on a predetermined area of the printing medium with use of the first ejection portion into first divided image data groups corresponding to a plurality of relative movements by using a first mask having print permitting ratios corresponding to the plurality of relative movements and dividing second image data to be printed on the predetermined area with use of the second ejection portion into second divided image data groups corresponding to the plurality of relative movements by using a second mask having print permitting ratios corresponding to the plurality of relative movements; and causing the first ejection portion to eject the first ink according to the first divided image data groups and causing the second ejection portion to eject the second ink according to the second divided image data groups, during the plurality of times of the relative movement for the predetermined area, wherein a permeation speed of the first ink in a case that the first ink is ejected on the second ink that has been ejected onto the printing medium is slower than a permeation speed of the second ink in a case that the second ink is ejected on the first ink that has been ejected onto the printing medium, and the print permitting ratio corresponding to a last half of the plurality of relative movements, in the second mask, is higher than the print permitting ratio corresponding to a last half of the plurality of relative movements, in the first mask.

In the eighth aspect of the present invention, there is provided an ink jet printing method of performing printing onto a printing medium by using a first ejection portion for ejecting first ink and a second ejection portion for ejecting second ink which is different type of ink from the first ink, said method comprising: performing a relative movement of the first and second ejection portions to the printing medium; dividing first image data to be printed on a predetermined area of the printing medium with use of the first ejection portion into first divided image data groups corresponding to the plurality of relative movements by using a first mask having print permitting ratios corresponding to the plurality of relative movements and dividing second image data to be printed on the predetermined area with use of the second ejection portion into second divided image data groups corresponding to the plurality of relative movements by using a second mask having print permitting ratios corresponding to the plurality of relative movements; and causing the first ejection portion to eject the first ink according to the first divided image data groups and causing the second ejection portion to eject the second ink according to the second divided image data groups, during the plurality of relative movements for the predetermined area, wherein a permeation speed of the first ink in a case that the first ink is ejected on the second ink that has been ejected onto the printing medium is slower than a permeation speed of the second ink in a case that the second ink is ejected on the first ink that has been ejected onto the printing medium, and the print permitting ratio corresponding to the last relative movement of the plurality of relative movements, in the second mask, is higher than the print permitting ratio corresponding to the last relative movement of the plurality of relative movements, in the first mask.

According to the above-described configuration, in a case that a permeation speed of the first ink in a case that the first ink is ejected and overlaps on the second ink that has been ejected onto the printing medium is slower than a permeation speed of the second ink in a case that the second ink is ejected and overlaps on the first ink that has been ejected onto the printing medium, respective ejection timings of the first and second ink from the first and second ejection portions are controlled so that a percentage of pixels to each of which the second ink is ejected after the first ink is ejected is higher than a percentage of pixels to each of which the first ink is ejected after the second ink is ejected. Further, in another configuration, the first and second image data are divided so that a percentage of pixels to each of which the second ink is ejected after the first ink is ejected is higher than a percentage of pixels to each of which the first ink is ejected after the second ink is ejected. In further another configuration, the print permitting ratio corresponding to the last half of the plurality of times of relative movement or last relative movement among the plurality times of the relative movement, in the second mask, is higher than the print permitting ratio corresponding to the last relative movement among the plurality times of the relative movement, in the first mask.

As a result, it is possible to prevent a permeation speed of the ejected ink from becoming slow overall, which makes it possible to reduce occurrence of beading.

Further features of the present invention will become apparent from the following description of exemplary embodiments (with reference to the attached drawings).

DESCRIPTION OF THE EMBODIMENTS

Hereinafter, embodiments of the present invention will be described in detail with reference to the drawings.

One embodiment of the present invention relates to so-called multi-pass printing in which respective cyan (C), magenta (M), and yellow (Y) inks are ejected in two scans. In this case, binary image data (hereinafter called "dot data" or "ejection data" as well) for driving the printing head of the respective C, M, and Y inks exist so as to correspond to a printing operation divided into two scans. In this specification, a set of image data (binary data or multi-valued data) distinguished according to the colors and the scans is called a "plane."

Figure 1A:
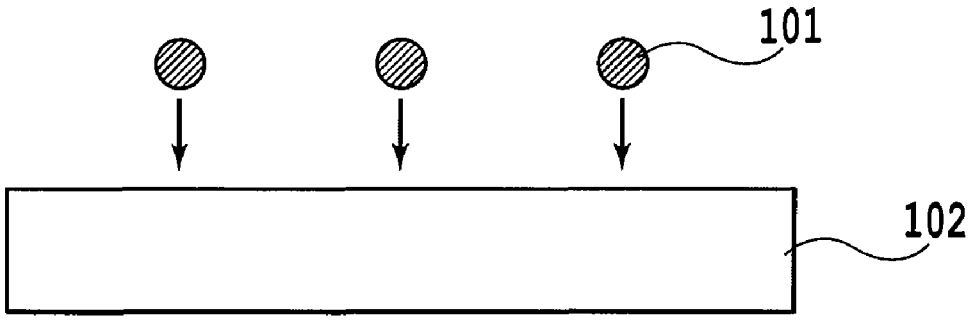
FIGS. 1A and 1B are diagrams for explaining fixation of inks corresponding to its permeation speed.
Figure 1B:
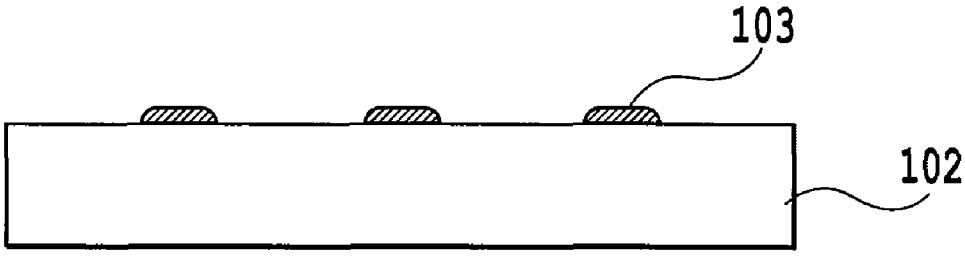
Figure 2A:
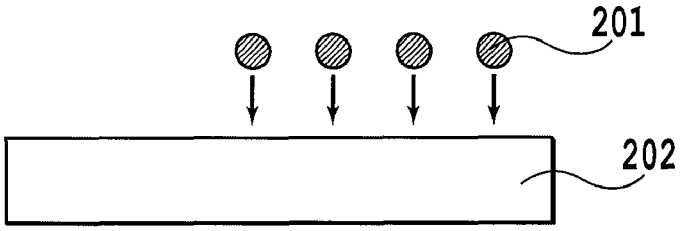
FIGS. 2A to 2F are diagrams for explaining beading which easily occurs in accordance with a permeation speed.
Figure 2B:
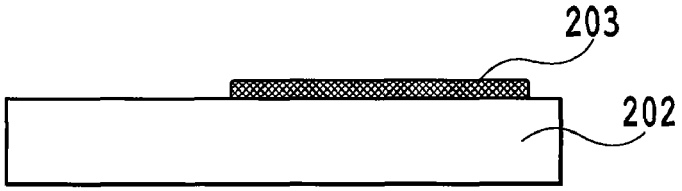
Figure 2C:
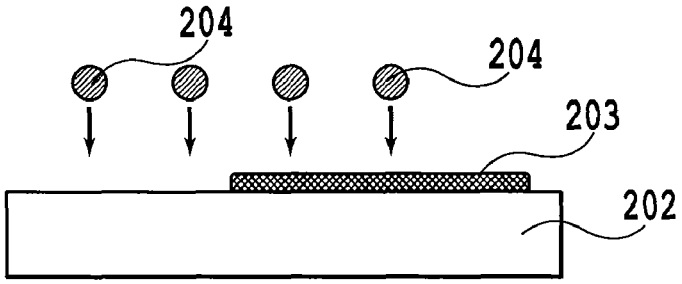
Figure 2D:
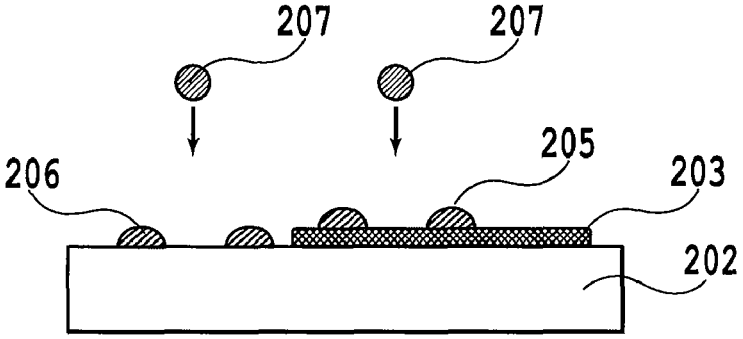
Figure 2E:
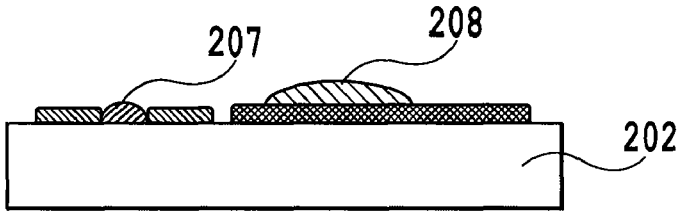
Figure 2F:
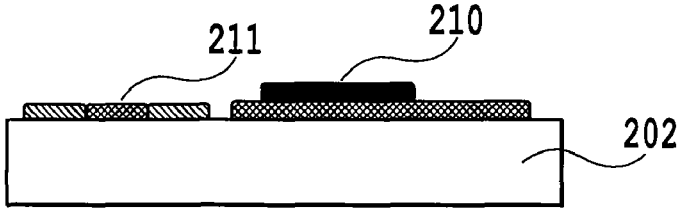
Figure 3:
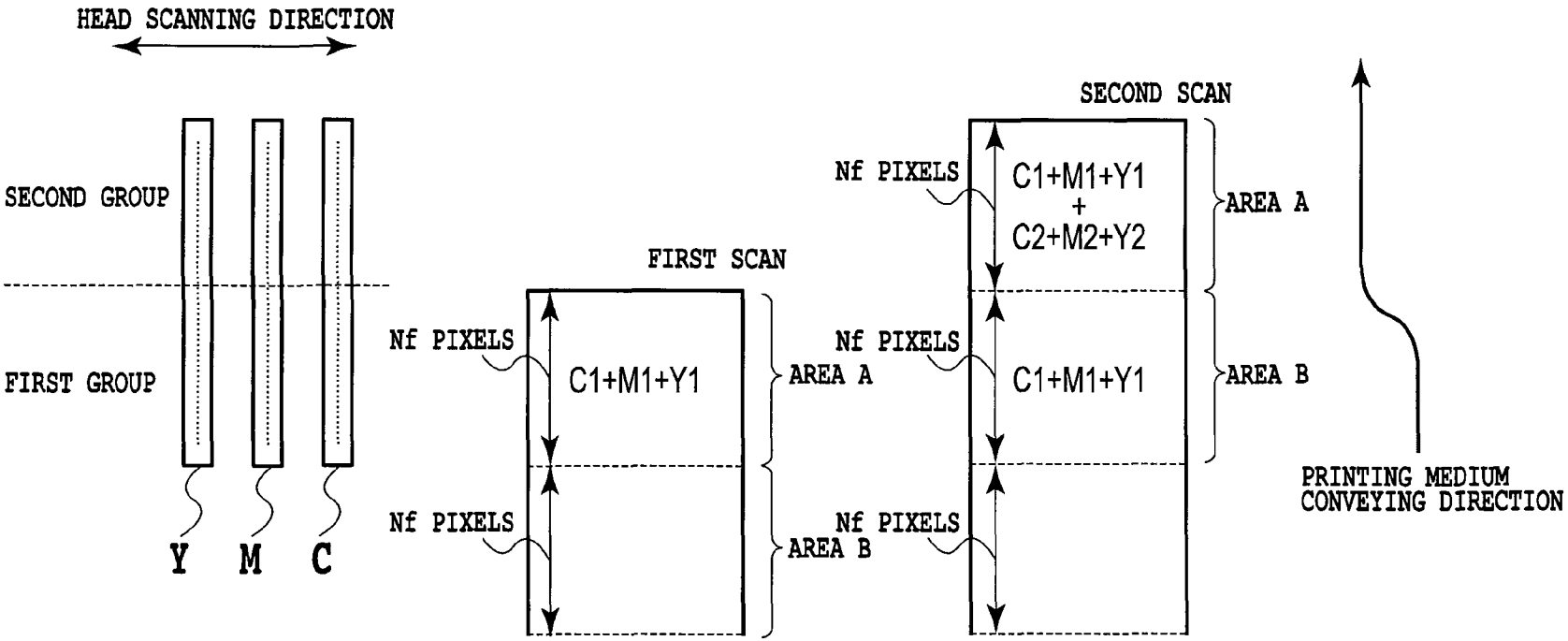
FIG. 3 is a diagram schematically showing a relationship between a printing head and a printing medium in two-pass multi-pass printing.

FIG. 3 is a diagram schematically showing a relationship between a printing head and a printing medium in two-pass multi-pass printing. In a case of two-pass printing, an image to be printed in a predetermined unit area on a printing medium is completed by two scans of a printing head.

In FIG. 3, a nozzle group of each color of cyan, magenta, and yellow is divided into two groups of a first group and a second group, and 256 nozzles are included in each group. Accordingly, the number of nozzles of each color in the printing head is 512. The nozzle group of each color ejects ink onto each unit area corresponding to an array width of the nozzle group on a printing medium while scanning in a direction substantially perpendicular to the nozzle array direction ("head scanning direction" shown by the arrow in the drawing). In the example shown in the drawing, C, M, and Y inks are ejected onto each unit area on the basis of the respective binary image data of the C, M, and Y inks. Further, every time scanning is completed, a printing medium is conveyed by a width of one group (here, 256 pixels which are the same as a width of the unit area) in a direction perpendicular to the scanning direction ("printing medium conveying direction" shown by the arrow in the drawing). Thereby, an image to be printed on each unit area is completed by two scans.

To describe in detail, by the first scanning, the printing is performed for a area A on the printing medium in the order of C, M, and Y by use of the first group in the C nozzle group, the first group in the M nozzle group, and the first group in the Y nozzle group. Next, by the second scanning, the remaining printing is performed for the area A on which the printing in the first scanning is completed, in the order of Y, M, and C by use of the second group in the C nozzle group, the second group in the M nozzle group, and the second group in the Y nozzle group. At the same time, the printing is performed for an area B in an unprinted state, in the order of Y, M, and C by use of the first group in the C nozzle group, the first group in the M nozzle group, and the first group in the Y nozzle group. Moreover, such an operation is continued, to perform printing for each unit area (the area A and the area B) in the order of C1, M1, Y1, Y2, M2, and C2 or in the order of Y1, M1, C1, C2, M2, and Y2.

Figure 4A:
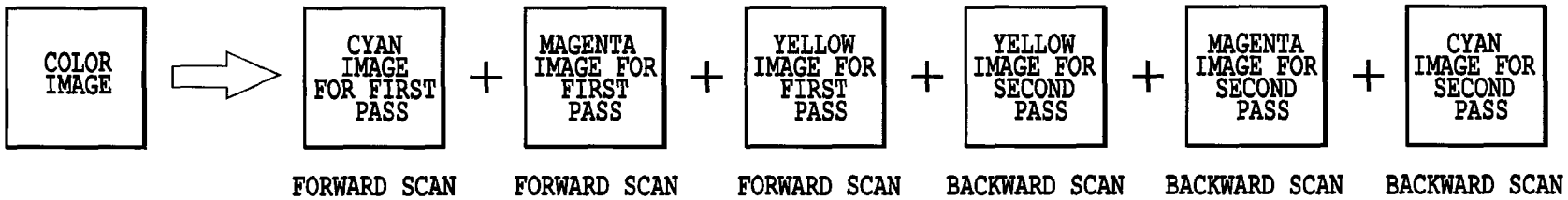
FIGS. 4A and 4B are diagrams for explaining printing orders with respect to unit areas in a case in which two-pass multi-pass printing is performed by use of C, M, and Y inks as that in FIG. 3.
Figure 4B:
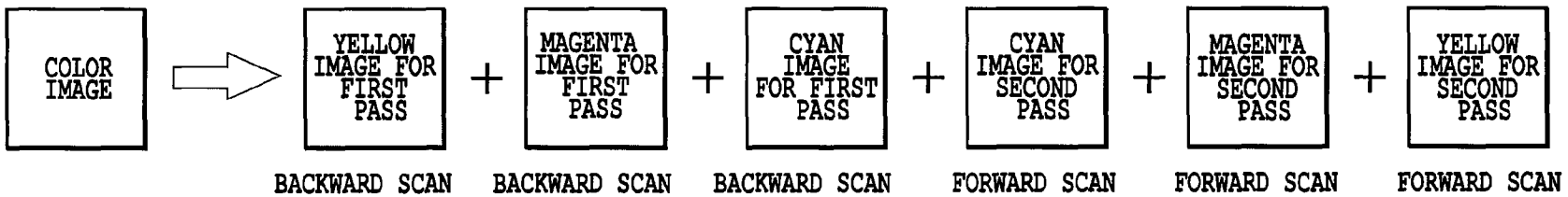

FIGS. 4A and 4B are diagrams for explaining printing orders with respect to unit areas in a case in which two-pass multi-pass printing is performed by use of C, M, and Y inks as that in FIG. 3.

FIG. 4A shows a situation in which an image on the region (the area A in FIG. 3) to be printed in the order of forward scanning and backward scanning comes to be completed. By the forward scanning (first pass) serving as the first scanning, first, a cyan image is printed on the basis of cyan binary data. Next, by the same scanning, respective magenta and yellow images are printed on the basis of binary data thereof in the same way. That is, the magenta image is printed so as to be overlapped on the cyan image printed prior to the magenta image, and moreover, the yellow image is printed so as to be overlapped on the cyan and magenta images printed prior to the yellow image in sequence. At this time, there is the risk of causing beading as described in FIGS. 2A to 2F, in the present embodiment, an application (discharge) order of the respective inks which will be described later is appropriately determined. Next, by the backward scanning (second pass) serving as the second scanning after the printing medium is conveyed by a predetermined distance, in the same way, images are printed in sequence so as to be overlapped on images printed prior thereto on the basis of the yellow, magenta, and cyan binary data generated by data segmentation which will be described later.

On the other hand, FIG. 4B shows a situation in which an image on the region (the area B in FIG. 3) to be printed in the order of backward scanning and forward scanning comes to be completed. By the backward scanning (first pass) serving as the first scanning, first, a yellow image is printed on the basis of yellow binary data. Next, by the same scanning, respective magenta and cyan images are printed on the basis of respective binary data thereof in the same way. That is, the magenta image is printed so as to be overlapped on the yellow image printed prior to the magenta image, and moreover, the cyan image is printed so as to be overlapped on the yellow and magenta images printed prior to the cyan image in sequence. By the forward scanning (second pass) serving as the second scanning after the printing medium is conveyed by the predetermined distance, in the same way, respective images are printed in sequence so as to be overlapped on the images printed prior thereto on the basis of the binary data of cyan, magenta, and yellow.

Figure 5:
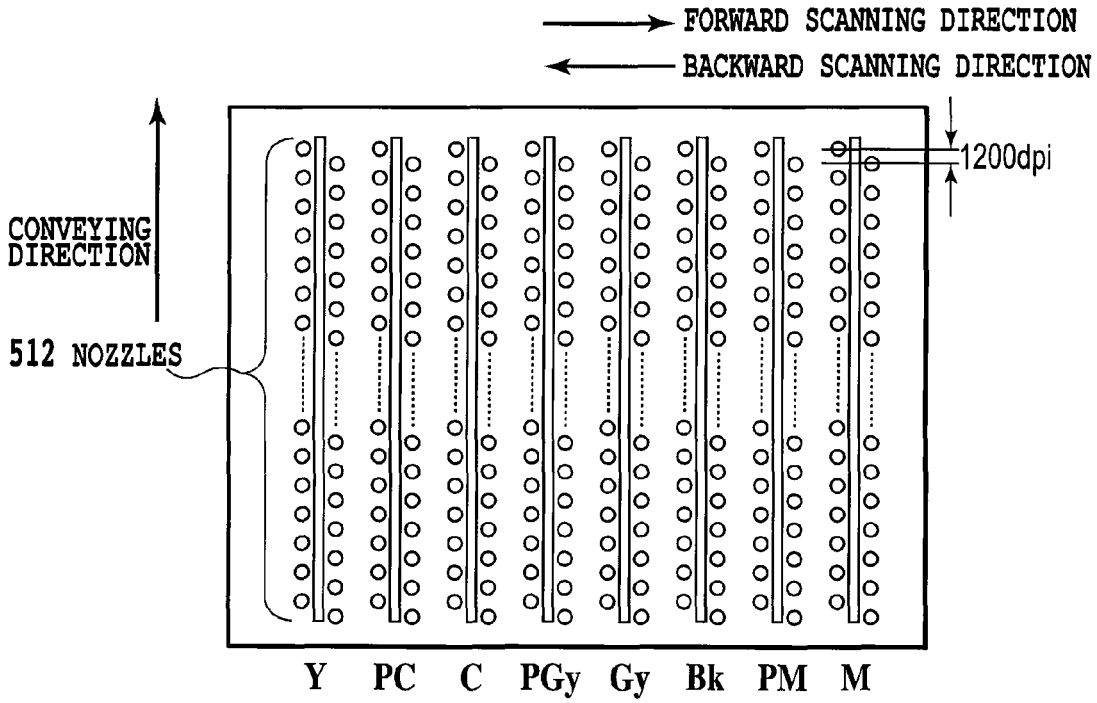
FIG. 5 is a diagram showing a printing head in which nozzles are respectively arrayed for yellow (Y), pale cyan (PC), cyan (C), pale gray (PGy), gray (Gy), black (Bk), pale magenta (PM), and magenta (M) inks.

Note that, it is clear from the following description that the present invention can be, in the same way, applied to a case in which four color inks in which black (Bk) is added to the three colors are used, and moreover, to a case in which pale inks with low color material densities and specific color inks such as red, blue, and green are further added to the four colors to be used. An example of such a printing head is shown in FIG. 5. FIG. 5 shows a printing head in which 512 nozzles are respectively arrayed for yellow (Y), pale cyan (PC), cyan (C), pale gray (PGy), gray (Gy), black (Bk), pale magenta (PM), and magenta (M) inks.

Figure 6:
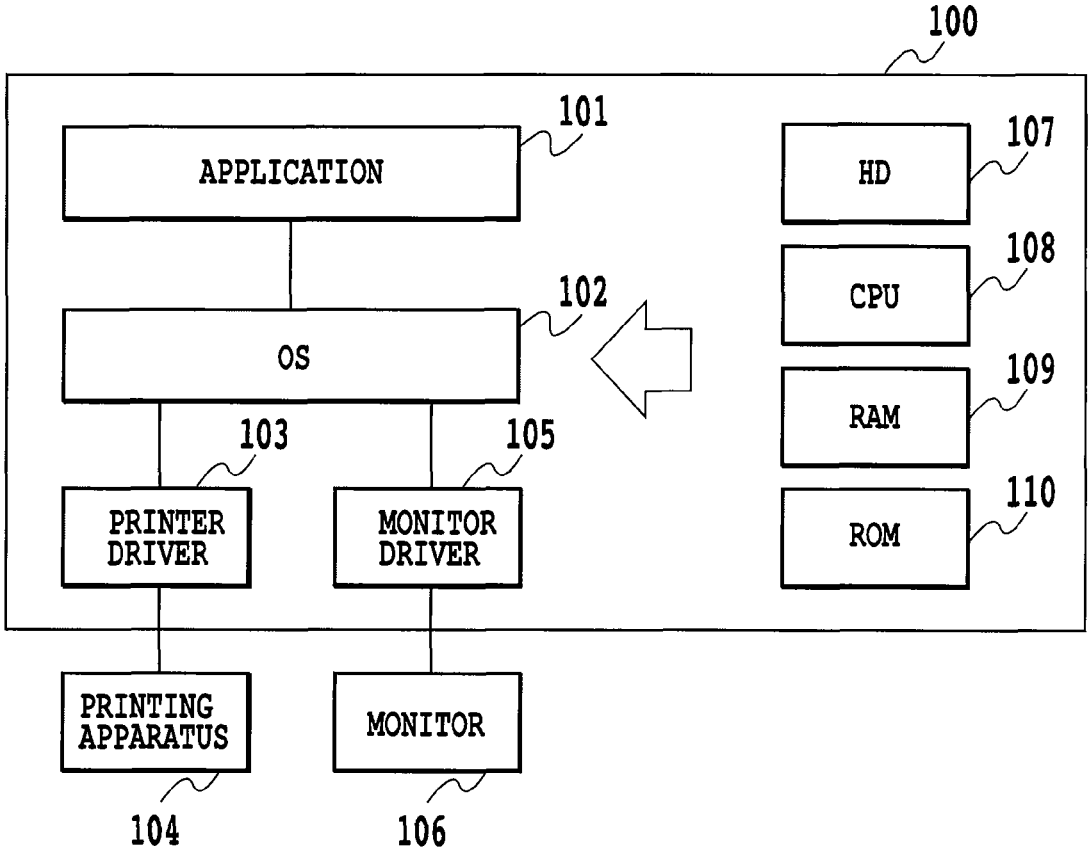
FIG. 6 is a block diagram showing mainly a configuration of hardware and software in a personal computer serving as an image data generating apparatus according to one embodiment of the present invention.

FIG. 6 is a block diagram showing mainly a configuration of hardware and software in a personal computer (hereinafter simply called PC as well) serving as an image data generating apparatus according to one embodiment of the present invention.

In FIG. 6, a PC 100 serving as a host computer operates the respective software of application software 101, a printer driver 103, and a monitor driver 105 by an operating system (OS) 102. The application software 101 executes processing of a word processor, a spreadsheet, and an Internet browser, and the like. The monitor driver 105 executes processing for creating image data to be displayed on a monitor 106 and the like.

The printer driver 103 executes image processing onto image data or the like issued from the application software 101 to the OS 102, to generate binary ejection data to be finally used in a printer 104. In detail, C, M, and Y binary image data used in the printer 104 are generated on the basis of C, M, and Y multi-valued image data. The binary image data generated in this way are transferred to the printer 104.

The host computer 100 includes a CPU 108, a hard disk drive (HD) 107, a RAM 109, a ROM 110, and the like as various types of hardware for operating the above software. That is, the CPU 108 executes processing thereof in accordance with a program of the above-described software stored in the hard disk 107 or the ROM 110, and the RAM 109 is used as a work area at the time of executing the processing.

The printer 104 in the present embodiment is, as described in FIG. 3, a so-called serial system printer that performs printing such that a printing head ejecting ink is made to scan a printing medium, and the ink is ejected during the scanning. A printing head having respective ejection opening groups corresponding to the respective C, M, and Y inks is mounted onto a carriage, to be capable of scanning a printing medium such as a printing sheet. Printing elements such as electrothermal conversion elements or piezoelectric elements are provided in channels communicated with the respective ejection openings of the printing head, and those printing elements are driven to discharge ink from the ejection openings. An array density of the respective ejection openings is 1200 dpi, and an ink of 3.0 pico-liters is ejected from each ejection opening. Further, the number of ejection openings in each color ejection opening group is 512.

Figure 7:
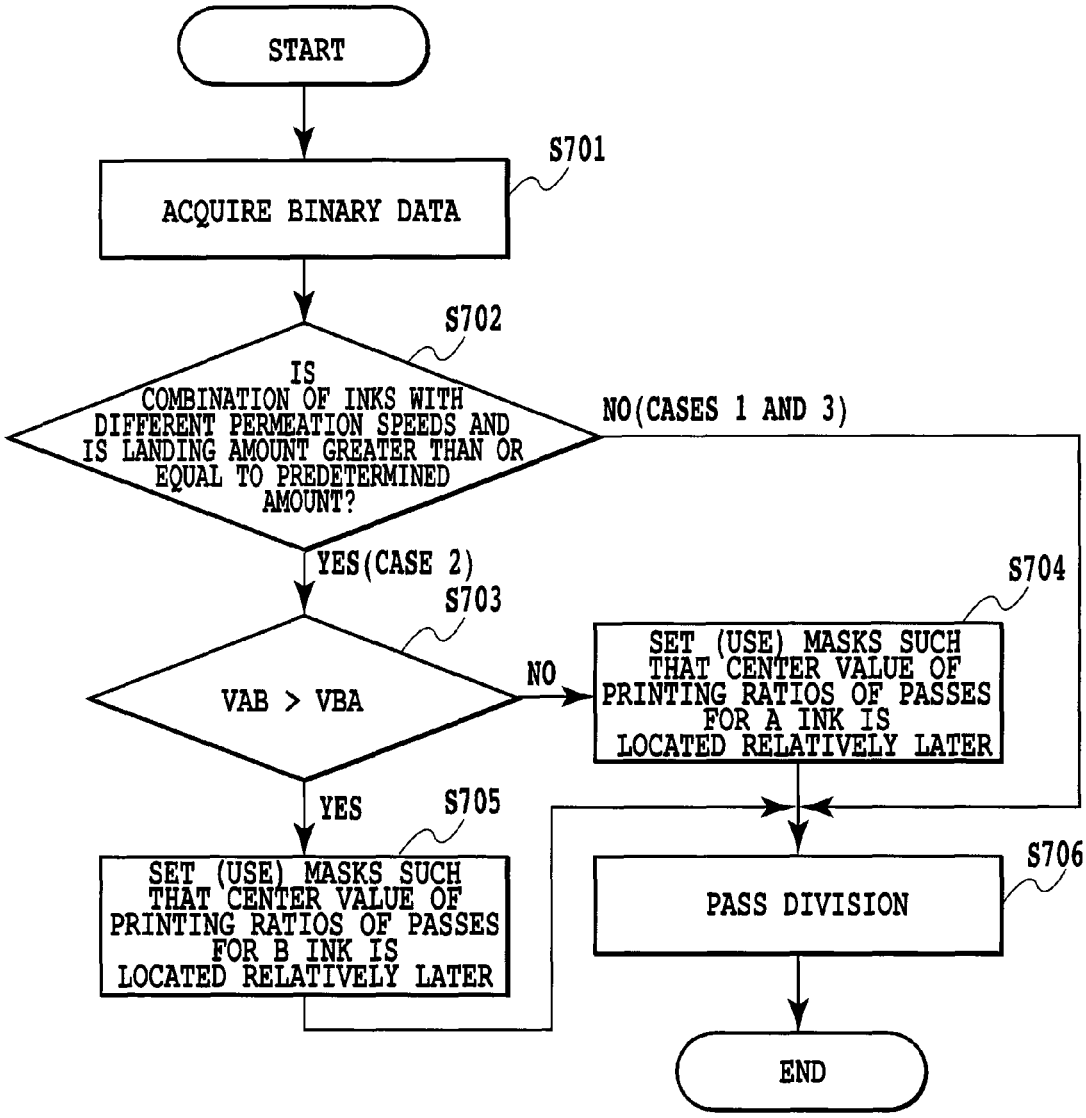
FIG. 7 is a flowchart for explaining binary (discharge) data generating processing in each pass according to a first embodiment of the present invention.
Figure 14:
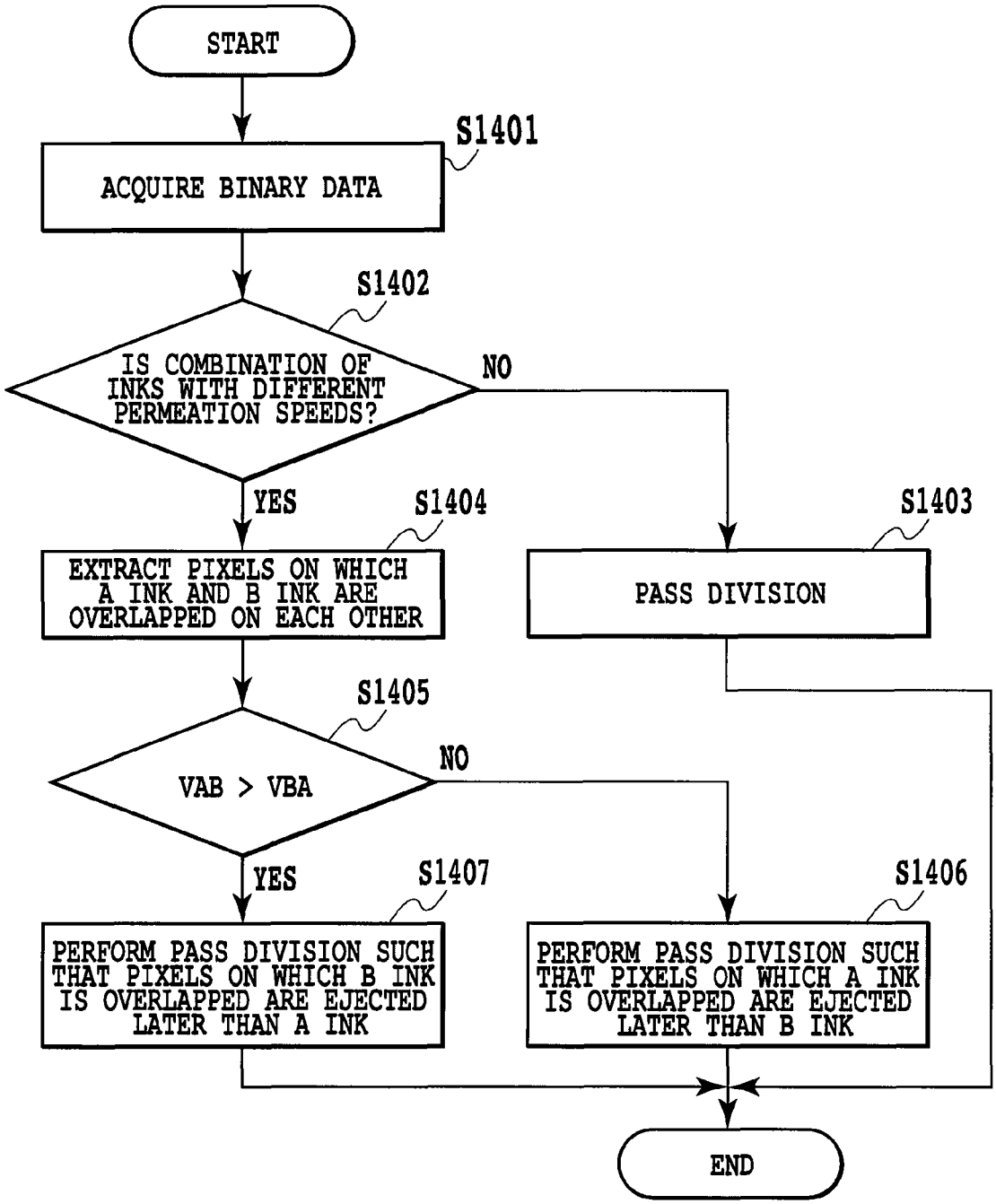
FIG. 14 is a flowchart showing one example of processing for dividing binary data into four planes of two color inks and two passes in a case in which two-pass multi-pass printing is performed, that is according to a modification of the second embodiment.
Figure 21:
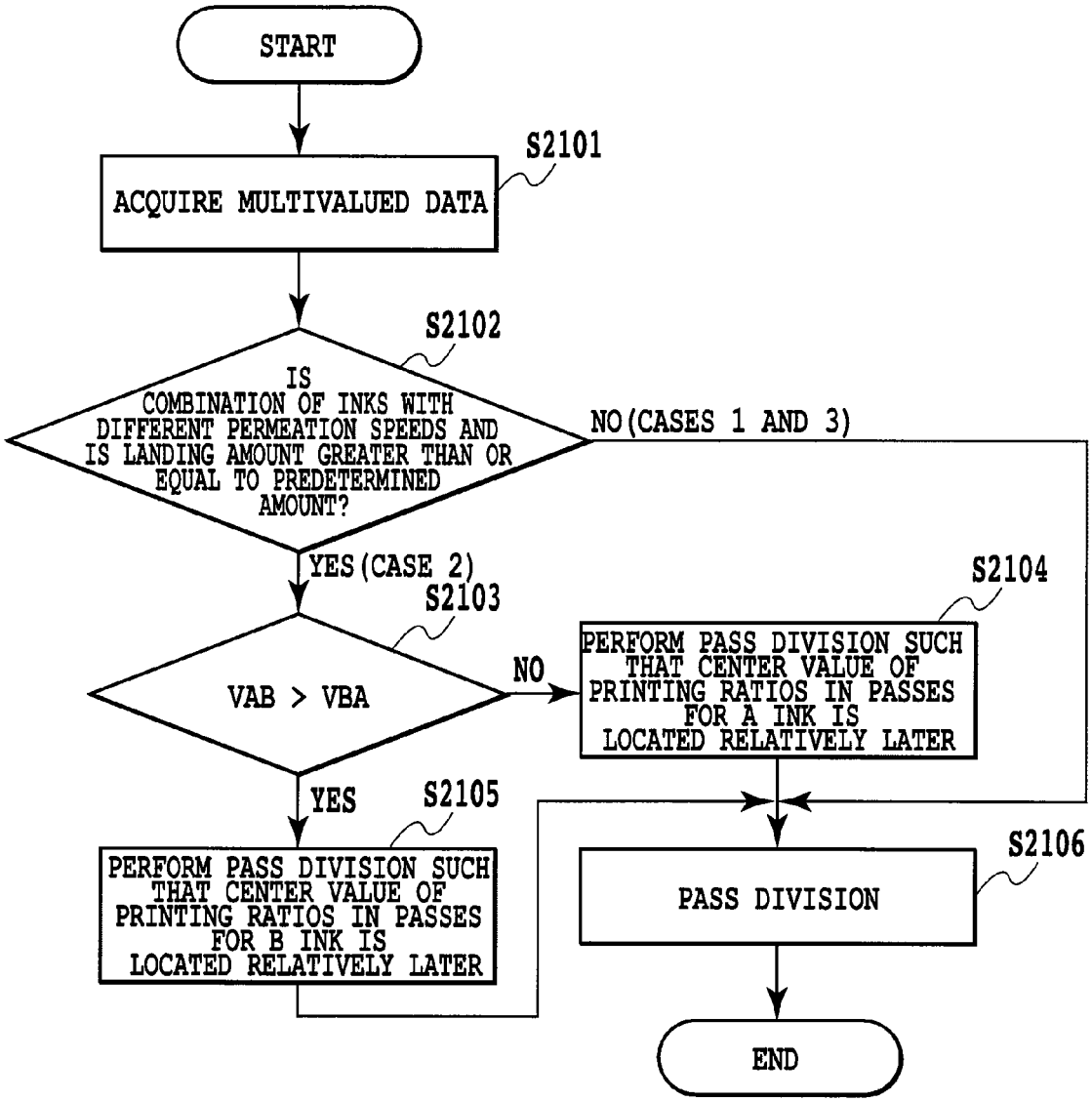
FIG. 21 is a flowchart for explaining processing for pass division and binarization in the fifth embodiment.

The printer 104 includes a CPU, a memory, and the like (not shown). The binary image data transferred from the host computer 100 is stored in the memory of the printer 104. Then, the binary image data stored in the memory is read out under the control of the CPU of the printer, and processing which will be described later in FIGS. 7, 14, and 21 are executed for the binary image data, and thereafter, the binary image data is transmitted to a driving circuit of the printing head. The driving circuit drives the printing elements in the printing head on the basis of the transmitted binary image data, to discharge ink from the ejection openings. That is, the CPU of the printer functions as means for causing the above described sections to execute multi-pass printing described later in following embodiments.

Next, several embodiments of the present invention will be described in which a permeation speed is made faster overall in a case where a permeation speed differs according to a applying (ejection) order of the respective color inks.

First Embodiment

In a first embodiment of the present invention, an ink with a lower P/B value is to be applied in a later pass. In the following description, for ease of explanation, it is given that an ink with a relatively low P/B value is a C ink and an ink with a relatively high P/B value is an M ink, and only the orders of applying these two inks will be described. In this case, an amount of the C ink with a relatively low P/B value to be applied in a later pass is made greater than an amount of the M ink with a relatively high P/B value. In the present specification, an "amount of ink to be applied" or a "applying amount" of ink means an amount of ink to be applied (be ejected) to a unit area, and specifically means a number of ink applying (number of ejection). More specifically, the "amount of ink to be applied" or the "applying amount" of ink means a ratio of a number of ink to be applied with respect to a number of pixels composing an area of the unit area, and for example the applying amount in a case that one ink is applied to each of all pixels composing the area of the unit area is expressed by 100%.

First, the respective components of the C and M inks used in the present embodiment will be hereinafter shown.

| C ink (P/B value = 2) | |
|---|---|
| Pigment | 2% |
| Styrene acrylate | 1% |
| Glycerin | 20% |
| Acetylenol EH | 1% |
| Water | Remaining % |
| M ink (P/B value = 3) | |
| Pigment | 3% |
| Styrene acrylate | 1% |
| Glycerin | 20% |
| Acetylenol EH | 1% |
| Water | Remaining % |

Four-pass multi-pass printing is performed in the bi-directional forward and backward scans by use of the C and M inks having the above-described components.

FIG. 7 is a flowchart for explaining binary (discharge) data generating processing for each pass according to the present embodiment. The processing shown in FIG. 7 is executed by the printer 104 of the present embodiment.

As shown in FIG. 7, first, in step 701, binary data for one scan which has been transmitted from the PC 100 to be stored in the predetermined memory is acquired. Further, along with the binary data, information on an ink applying amount per unit area for which printing is completed through four passes, and information on a permeation speed, which will be described hereinafter, of each ink to be used are acquired. Here, "unit area" corresponds to an area having a size of 16 pixels×16 pixels. A process of binary data generation for each scan (pass division), which will be described hereinafter, is performed for the unit area.

Next, in step 702, it is judged whether or not the acquired permeation speeds of the respective C and M inks are different from each other, and the ink applying amount per unit area is greater than or equal to a predetermined amount. Specifically, a combination of ink colors of binary data in the above unit area and an applying amount of the ink colors are determined. In the present embodiment, types of ink used in the apparatus are fixed and the permeation speeds of the inks in any combination differ from each other. Therefore, in actuality, it is only judged whether or not the ink applying amount per unit area is greater than or equal to a predetermined amount in step 702. That is, in accordance with a judgment on the applying amount of inks expressed by binary data of the unit area, the processing shifts to next step 703 or step 706. It should be noted that in an apparatus in which inks having different permeation properties form each other are changeably used, for example, in a case that plural types of ink having same color but containing different components are selectively used, as a matter of course, it is judged whether or not the permeation speeds of the inks are different from each other, and the ink applying amount per unit area is greater than or equal to a predetermined amount.

It should be noted that the above described example corresponds to a case that binary data composing an image of the unit area is data of C and M inks. However, as a matter of course other combination of two types of ink such as two types of Y and M ink used for printing a green color are also subjected to a similar process to a process described below. Further, also in a case of printing a third color such as gray or black and a case of performing printing using three or more types of ink, basically a similar process can be performed as described later. In addition, in a case of the combination including light color ink in which a concentration of color material such as dye and pigment is low, a similar process can be performed.

In the present example, the P/B value of the C ink with respect to the printing medium is smaller than the P/B value of the M ink. That is, the C ink functions as a filling material with respect to the M ink. In accordance with the above greatness relationship of the P/B value, a relationship of permeation speeds when one ink applied to the other ink layer is determined. That is, the C and M inks are in a relationship of VCM<VMC with respect to their permeation speeds. Here, VAB denotes a permeation speed when an ink B is applied to a layer formed by applying of an ink A thereto already, and VBA denotes a permeation speed in the reverse case. In this way, in the present embodiment, when VCM and VMC are different from each other, it is judged that "the permeation speeds are different from each other." It should be noted that in the present embodiment, the above judgment is not performed and only the ink applying amount is judged, and then the processing shift to a next step according to the judgment, as described above.

Further, in the present embodiment, in a case in which an applying amount of the C ink, which makes a permeation speed slower, with respect to a unit area is greater than or equal to 60%, and a total applying amount of the C and M inks applied to the unit area is greater than 120%, it is judged that "an ink applying amount is greater than or equal to the predetermined amount."

When it is judged that the condition of "the respective permeation speeds VMC and VCM of the C and M inks are different from each other, and an ink applying amount per unit area is greater than or equal to the predetermined amount" is not satisfied (including cases 1 and 3 which will be described later) in step 702, a pass division is performed in step 706. Specifically, mask processing is executed for the acquired binary data by use of a mask in which a print permitting ratio for the unit area, for which printing is completed through four passes, and for each of passes is determined, to generate ejection data of each pass. The mask which will be described in the cases 1 and 3 are used as the mask.

On the other hand, when it is judged that the condition of "the respective permeation speeds of the C and M inks are different from each other, and an ink applying amount per unit area is greater than or equal to the predetermined amount" is satisfied (including a case 2 which will be described later) in step 702, VAB and VBA are compared with each other in step 703. Then, when VAB is smaller (slower) than VBA, the A ink is made ejected in a later pass in step 704. On the other hand, when VBA is smaller (slower) than VAB, the B ink is made ejected in a later pass in step 705.

It should be noted that in the present embodiment, since the relation between permeation speeds of used inks is known as described above, setting a mask used for the pass division is performed as a process of step 704 or step 705, in accordance with a combination of types of ink shown by the data composing an image of the unit area. More specifically, masks for respective types of ink are previously fixed for each combination of two types of ink used in the apparatus, and thus the mask corresponding to the combination determined in step 702 is read out in step 704 or step 705.

In addition, the mask not always have to be determined for each combination of two types of ink. For example, in an apparatus using four types of C, M, Y and k inks, a mask for each combination of two types of ink which is obtained from the four types of ink is not determined but a mask for each of the four types of ink may be determined based on relation between respective permeation speeds of four types of ink. Then, the masks thus determined may satisfy a relation described below as the mask for each of two types of ink determined in step 702.

In the case of the present example, since the relationship of VCM<VMC is established, an amount (rate) of the C ink that makes a permeation speed slower and is applied in a later pass among the four passes for completing printing is made greater. Specifically, processing for setting masks used for the pass division in step 706 is executed in accordance with a high and low relationship of the above-described permeation speeds. In other words, the center of gravity of the print permitting ratios in the C ink mask, which makes a permeation speed slower, with respect to a pass is to be located in a pass relatively later than the center of gravity of the M ink mask.

Thereby, it is possible to reduce an amount of the M ink applying later than the C ink whose "filling function reduces a permeation speed of an ink applied later," and it is possible to prevent a time to complete permeation from slowing down overall. As a result, it is possible to prevent the occurrence of beading due to the inks applied before and after contacting with each other.

As described above, selecting a mask used for the pass division is performed in accordance with a combination of colors (types) of ink shown by binary data composing an image of the unit area and the ink applying amount acquired from the above binary data, which are determined in step 702. Also in a case that types of ink shown by binary data composing an image of the unit area is three or more types, selecting mask may be similarly performed. For example, as described later in fourth embodiment, is types of used ink is three types, a process of step 702 detects that binary data composing an image of the unit area shows combinations of three types of C, M and Y inks similarly to the above. Then, since the permeation speed of inks used in the apparatus of the present embodiment are known to be different from each other, directly the ink applying amount of each ink in the combination and a total ink applying amount as sum of the ink applying amounts, and then it is judged whether the each ink applying amount is equal to or greater than the predetermined amount. A criterion for the above judgment is for example as follows. When respective ink applying amounts of C ink, M ink and Y ink, which are an order of making the permeation speed slower, are 60% or more, 40% or more and 30% or more, and the total ink applying amount of C, M and Y inks is greater than 120%, it may be judged that "the ink applying amount is equal to or greater than the predetermined amount. After the above process in step 702 in the case of using three types of ink, a process of selecting the used mask is performed similarly to the above, and a process of the pass division is performed using the selected mask as described later in the fourth embodiment.

The masks used for pass division in the binary data generating processing in the present embodiment described above will be described hereinafter with reference to the representative cases 1, 2 and 3. The cases 1, 2 and 3 are to be distinguished in accordance with a combination of applying amounts of the respective C and M inks to a unit area, and those are as follows.

Case 1: A case in which the C ink singularly is applied (100%:0%)

Case 2: A case in which the C ink and the M ink are applied in a large amount (100%:100%)

Case 3: A case in which the C ink and the M ink are applied in a small amount (25%:25%)

The case 1 is a case in which only the C ink is applied, and corresponds to a case in which a cyan color image is printed.

The case 1 is an example in which it is judged that the condition of "the respective permeation speeds VMC and VCM of the C and M inks are different from each other, and an ink applying amount per unit area is greater than or equal to the predetermined amount" is not satisfied in step 702 of FIG. 7. However, the respective permeation speeds VMC and VCM of the C and M inks used in the present embodiment are different from each other. That is, this case is a case in which the respective permeation speeds VMC and VCM of the C and M inks are different from each other, but the condition of "an ink applying amount per unit area is greater than or equal to the predetermined amount" is not satisfied. In this case, masks are used in view of the advantageous effects of conventionally-known multipass printing and gradation printing, concretely, a reduction in stripes and granular feeling due to the ejection properties of the nozzles, a reduction in connection stripes due to air current, a reduction in connection stripes due to paper-conveying errors.

Figure 8B:
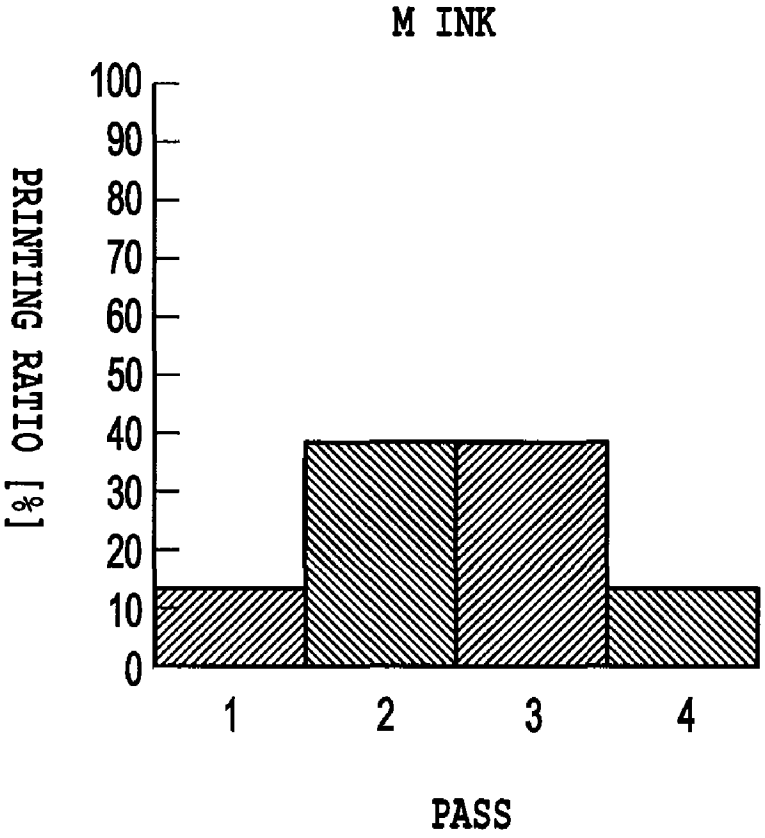
FIGS. 8A and 8B are graphs showing print permitting ratios of masks according to one conventional example.
Figure 8A:
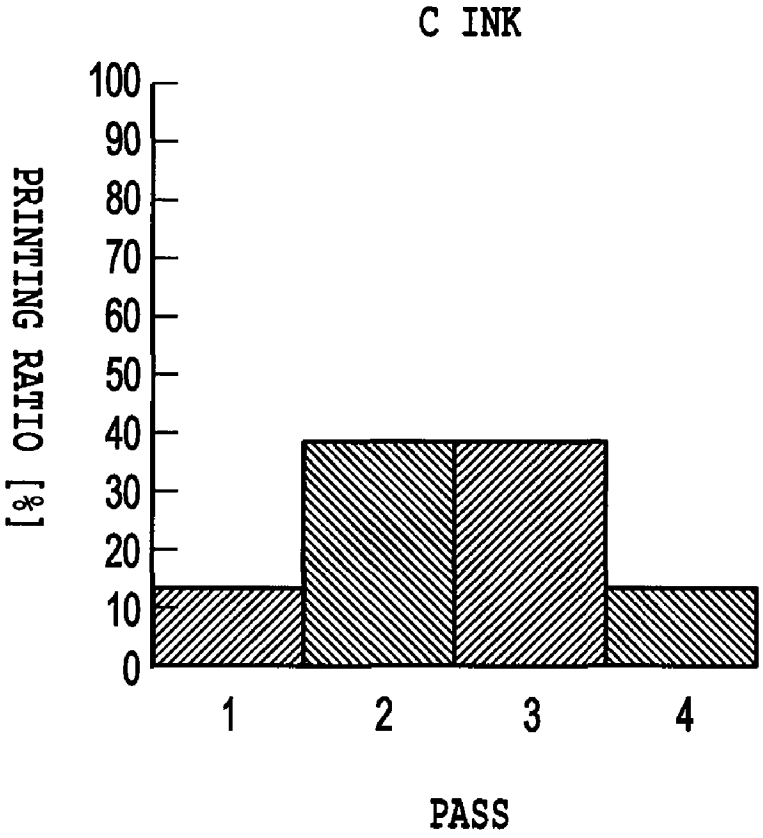

FIGS. 8A and 8B are graphs showing masks used in the case 1, and in detail, FIG. 8A shows print permitting ratios in the respective passes of the C ink and FIG. 8B shows print permitting ratios in the respective passes of the M ink. Here, the masks are composed of mask elements each of which determines "output (permitting printing)" or "non-output (non-permitting printing)" of printing data in a pixel of printing data so as to correspond to the pixel of printing data, and a "print permitting ratio (also referred to as "print permitting ratio")" denotes a ratio of the mask elements that determines "output (permitting printing)" of printing data. Patterns of the mask elements of the respective masks corresponding to the plurality of passes, which are used in a case in which printing per unit area is completed by a plurality of passes (scans) as in the present example, are complementary to each other, and accordingly, a total of the print permitting ratios of the masks corresponding to the plurality of passes becomes 100%.

As shown in FIGS. 8A and 8B, the contents of the masks for the C and M inks used in the case 1 are the same. That is, these masks are so-called gradation masks in which the print permitting ratios in the first pass and the fourth pass are lower than the print permitting ratios in the second pass and the third pass. The print permitting ratios thereof are 12.5%, 37.5%, 37.5%, and 12.5% in the order from the first pass. Note that, in the case 1, because a applying amount per unit area of the M ink is 0% as described above, an image of the M ink is not printed in practice.

The case 2 corresponds to a case in which a deep blue image is printed. The case 2 is an example in which the C and M two color inks are equally used and are used in relatively large amounts to performing printing. The case 2 is a case in which it is judged that the condition of "the respective permeation speeds of the C and M inks are different from each other, and an ink applying amount per unit area is greater than or equal to the predetermined amount" is satisfied in step 702 of FIG. 7. In this example, beading by filling of the C ink applied prior to the M ink significantly occurs. Therefore, in order to improve the slowing down of a permeation speed overall by filling of the C ink, masks through which the C ink is applied in as late pass as possible are used.

Figure 9B:
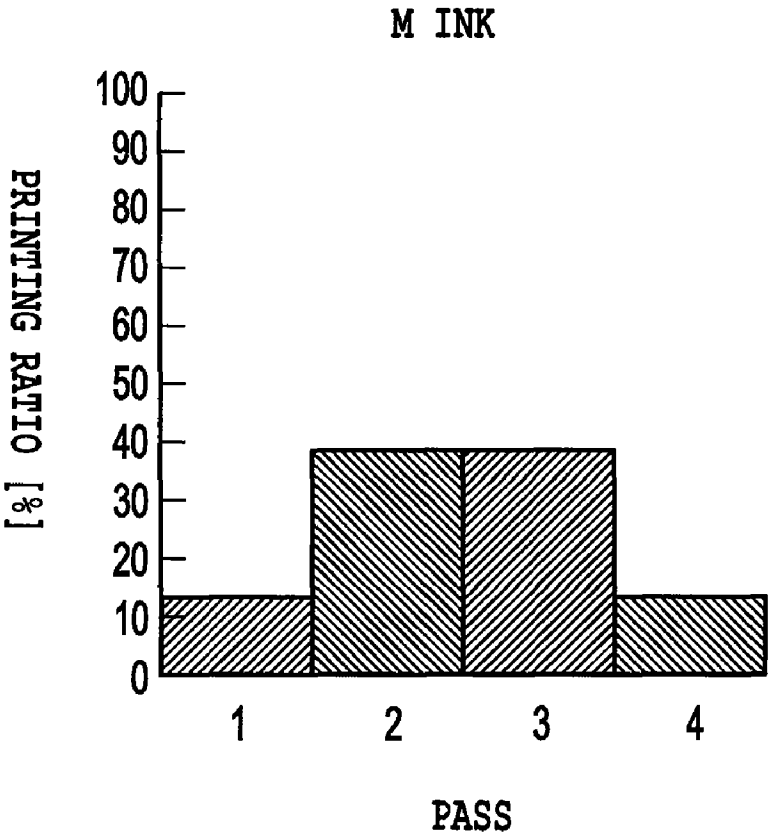
FIGS. 9A and 9B are graphs showing masks used in the first embodiment.
Figure 9A:
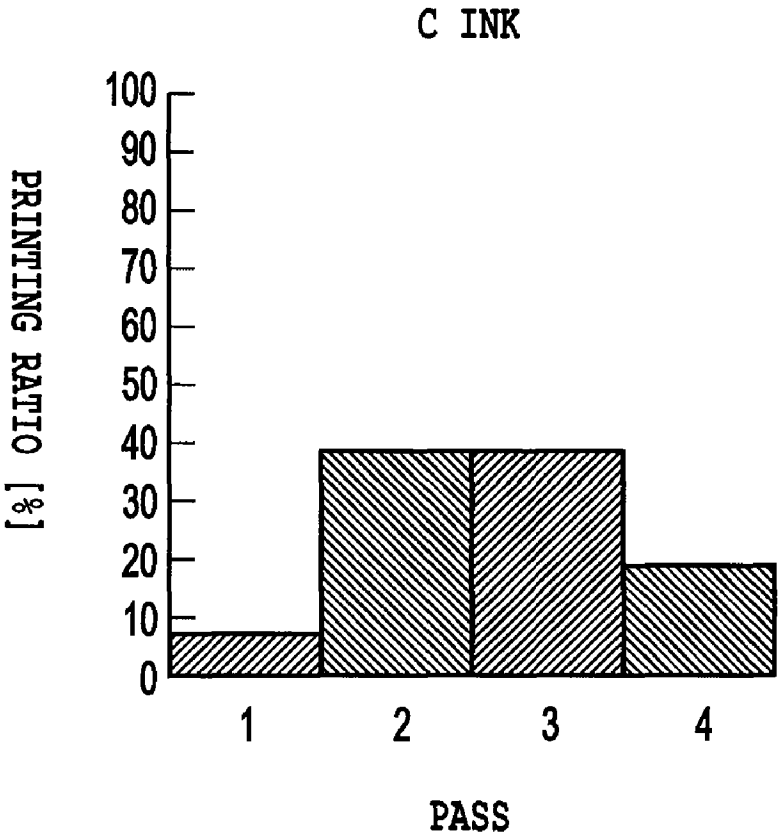

FIGS. 9A and 9B are graphs showing masks used in the case 2, and FIG. 9A shows print permitting ratios in the respective passes of the C ink and FIG. 9B shows print permitting ratios in the respective passes of the M ink.

As shown in FIG. 9A, the print permitting ratios of the masks for the first to fourth passes of C ink are respectively 6.2%, 37.5%, 37.5%, and 18.8%. On the other hand, as shown in FIG. 9B, the print permitting ratios of the masks for the first to fourth passes of M ink are respectively 12.5%, 37.5%, 37.5%, and 12.5% similarly to the case 1. As in this case, the print permitting ratio of C ink for the latest fourth pass is higher than that of M ink and the print permitting ratio of C ink for the first pass is lower than that of M ink accordingly. In this way, the masks of C ink having higher print permitting ratios for the last half pass (in a case of four passes, a total print permitting ratio of the third and fourth passes) than the masks of M ink is used and the masks of M ink having lower print permitting ratios for the last half pass than the masks of C ink is used. Thereby, the amount of M ink applied to and after C ink that has high filling effect can be made small and thus entire permeation speed can be prevented from being made slow. Note that the above relation of the print permitting ratios in the last half pass brings to an inverse relation in a first half pass because respective masks are complement to each other. Accordingly, the relation of the print permitting ratios in the last half pass can ensure that the respective masks are determined so that C ink is applied in a larger amount in a later pass than M ink, in entire masks corresponding to respective passes. In addition, the present invention is not limited to be applied to the print permitting ratios for the last half pass, masks of C ink has higher print permitting ratio than the masks of M ink in a last pass may be used and masks of M ink has lower print permitting ratio than the masks of C ink in the last pass may be used. In the masks having the above relation, since respective masks have complement relation to each other, in most cases, it is possible to reduce an amount of the M ink to be applied later and to the C ink functioning to "reduce a permeation speed of an ink applied later by filling," and it is thus possible to prevent a permeation speed from slowing down overall. As a result, it is possible to prevent the occurrence of beading due to a time to complete permeation becoming longer.

Note that in a case of completing an image by odd number of times of scan ((2 n+1) passes), the above described "last half pass" may designate (n+2)-th pass, (n+3)-th pass, 2 n-th pass, (2 n+1)-th pass, in which midmost pass is omitted. for example.

The fact that the a larger amount of the C ink is applied in a later pass as compared with the M ink means that "the center of gravity of the print permitting ratios of the C ink mask is located in a later pass than that in which the center of gravity of the print permitting ratios of the M ink mask is located." This is not limited to the relationship shown in FIGS. 9A and 9B. For example, a relationship that the print permitting ratios of the masks in the first to fourth passes of M ink are respectively 17.5%, 37.5%, 37.5%, and 7.5%, and the print permitting ratios of the masks in the first to fourth passes of C ink are respectively 12.5%, 37.5%, 37.5%, and 12.5% is included as well. That is, a case in which a larger amount of the M ink is applied in an earlier pass as compared with the C ink is included as well. Moreover, a relationship such that the print permitting ratios of the masks in the first to fourth passes of M ink are respectively 17.5%, 37.5%, 37.5%, and 7.5%, and the print permitting ratios of the masks in the first to fourth passes of C ink are respectively 7.5%, 37.5%, 37.5%, and 17.5% is included as well.

The above-described center of gravity can be expressed by the following formula.

$$\Sigma(n \times fX(n))/\Sigma fX(n)$$

Here, fX(n) means a print permitting ratio in the n-th pass of X ink, and Σ takes a sum of 1 to a total number of passes N with respect ton. Further, in a case in which N masks of the respective inks are complementary to each other, and a applying ratio in the N passes becomes 100%, $\Sigma fX(n)=100\%$.

More detail explanation of the "center of gravity" will be made as follows. When applying values of the masks of C ink shown in FIG. 9A to the above expression, it is established that (1×6.2+2×37.5+3×37.5+4×18.8)/(6.2+37.5+37.5+18.8)=2.7. On the other hand, when applying values of the masks of M ink shown in FIG. 9B to the above expression, it is established that (1×12.5+2×37.5+3×37.5+4×12.5)/(12.5+37.5+37.5+12.5)=2.5. Here, the center of gravity of 2.5 that corresponds to the case shown in FIG. 9B means that the center of gravity is located at just a middle point between the second and third passes. Further, the center of gravity of 2.7 that corresponds to the case shown in FIG. 9A means that the center of gravity is located between the second and third passes and near the third pass. Then, these values of the center of gravity means that an amount of ink applied in later passes is greater in the case that "the center of gravity is located between the second and third passes and near the third pass" than in the case that "the center of gravity is located at just a middle point between the second and third passes". It should be noted that any of masks shown in FIGS. 8A and 8B has the location of center of gravity being 2.5, that is, being just a middle point between the second and third passes.

A relationship between the centers of gravity of the print permitting ratios of the C and M inks in the case 1 is;

$$\Sigma(n\times fC1(n))/\Sigma fC1(n)=\Sigma(n\times fM1(n))/\Sigma fM1(n).$$

As described above, in a case of ΣfC1(n)=ΣfM1(n)=100%, the relationship can be expressed by Σ(n×fC1(n))=Σ(n×fM1(n)).

On the other hand, a relationship between the centers of gravity of the print permitting ratios of the C and M inks in the case 2 is;

$$\Sigma(n\times fC2(n))/\Sigma fC2(n)>\Sigma(n\times fM2(n))/\Sigma fM2(n).$$

In the same way, in a case of ΣfC2(n)=ΣfM2(n)=100%, the relationship can be expressed by Σ(n×fC2(n))>Σ(n×fM2(n)) as well. This relationship means that the center of gravity of the print permitting ratios with respect to the passes of the C ink is greater than the center of gravity of the print permitting ratios of the M ink, and is located in a later pass.

Figure 10:
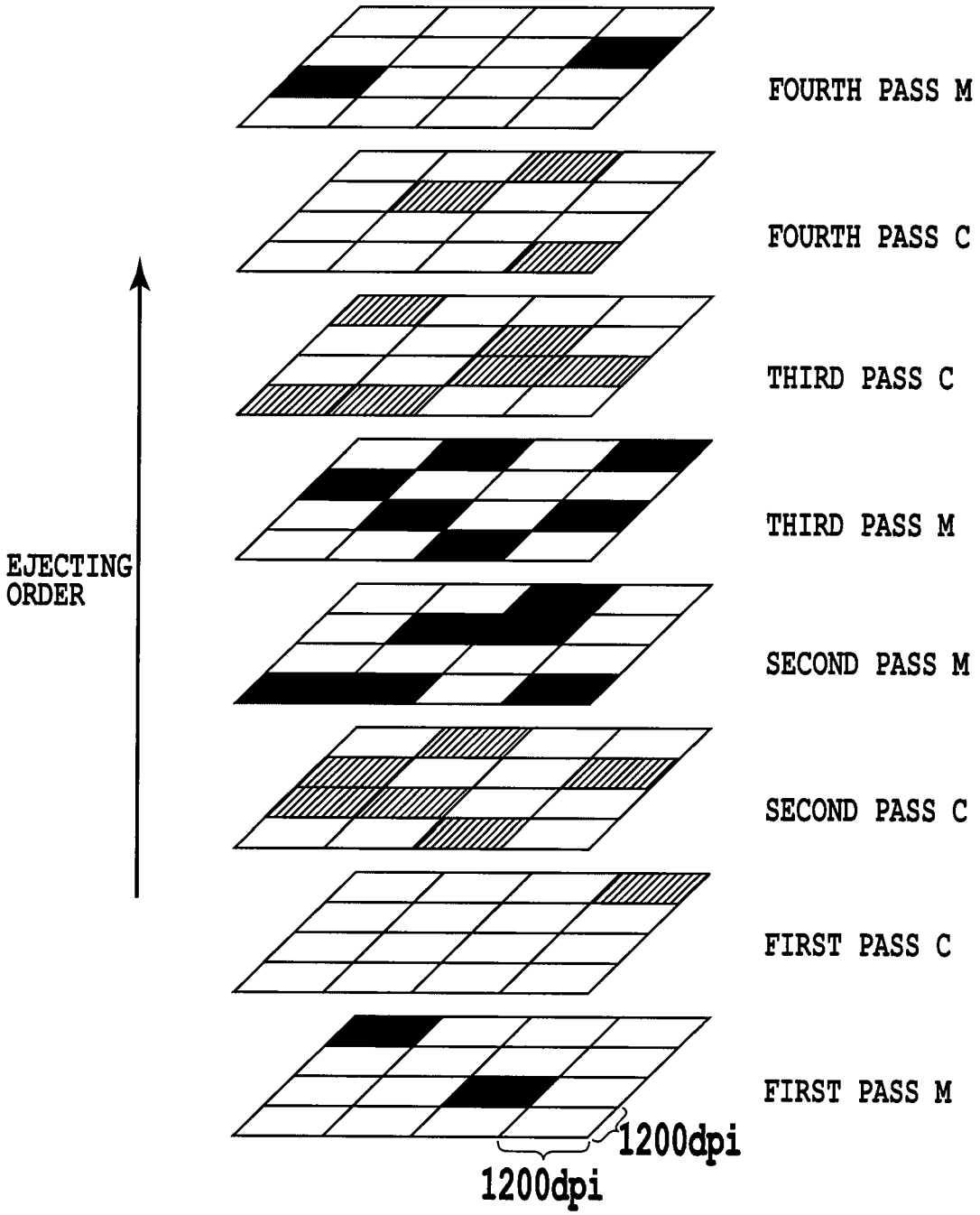
FIG. 10 is a diagram showing mask patterns, for which print permitting ratios are determined for the respective passes, of the C and M inks shown in FIGS. 9A and 9B.

FIG. 10 is a diagram showing mask patterns, for which print permitting ratios are determined for the respective passes, of the C and M inks shown in FIGS. 9A and 9B. Mask elements shown by black or oblique lines denote mask elements to determine "output (permitting printing)" of printing data of the pixels so as to correspond to pixels of printing data. On the other hand, blank mask elements denote mask elements to determine "non-output (non-permitting printing)" of printing data. Note that, the number of the mask elements in each mask shown in FIG. 10 is 16. However, this is for ease of illustration, and actually the number of the mask elements along a nozzle array direction in each mask corresponds to the number of nozzles of each color ink in the printing head. Note that, FIG. 10 shows patterns of ink dots formed in the respective passes in a case of image data in which respective applying amounts of the C and M inks become 100%.

In FIG. 10, since the mask for M ink has the print permitting ratio of 12.5% in the first pass as described above, two mask elements among the sixteen mask elements serve as mask elements to determine "output (permitting printing)" of the printing data. On the other hand, since the mask for the C ink has the print permitting ratio of 6.2% in the first pass, one mask element among the sixteen mask elements serves as a mask element to determine "output (permitting printing)" of the printing data. Since the masks of the both M and C inks have the print permitting ratios of 37.5% in the second pass and the third pass, six mask elements among the sixteen mask elements serve as mask elements to determine "output (permitting printing)" of the printing data. Then, since the masks of the M and C inks respectively have the print permitting ratios of 12.5% and 18.8% in the final fourth pass, two and three mask elements among the sixteen mask elements serve as mask elements to determine "output (permitting printing)" of the printing data. In this way, the masks through which C ink functioning to "reduce a permeation speed of an ink applied later by filling" is applied in a later pass as compared with the M ink are used. In other words, the masks according to the present embodiment can make a ratio of pixels to which C ink is ejected after M ink is ejected larger than that of pixels to which M ink is ejected after C ink is ejected.

The case 3 corresponds to a case in which a pale blue image is printed. The case is, in the same way as the case 1, an example in which it is judged that the condition of "the respective permeation speeds VMC and VCM of the C and M inks are different from each other, and an ink applying amount per unit area is greater than or equal to the predetermined amount" is not satisfied in step 702 of FIG. 7. However, the respective permeation speeds VMC and VCM of the C and M inks used in the present embodiment are different from each other. That is, this case 3 as well is a case in which the respective permeation speeds VMC and VCM of the C and M inks are different from each other, but the condition of "an ink applying amount per unit area is greater than or equal to the predetermined amount" is not satisfied.

Figure 11B:
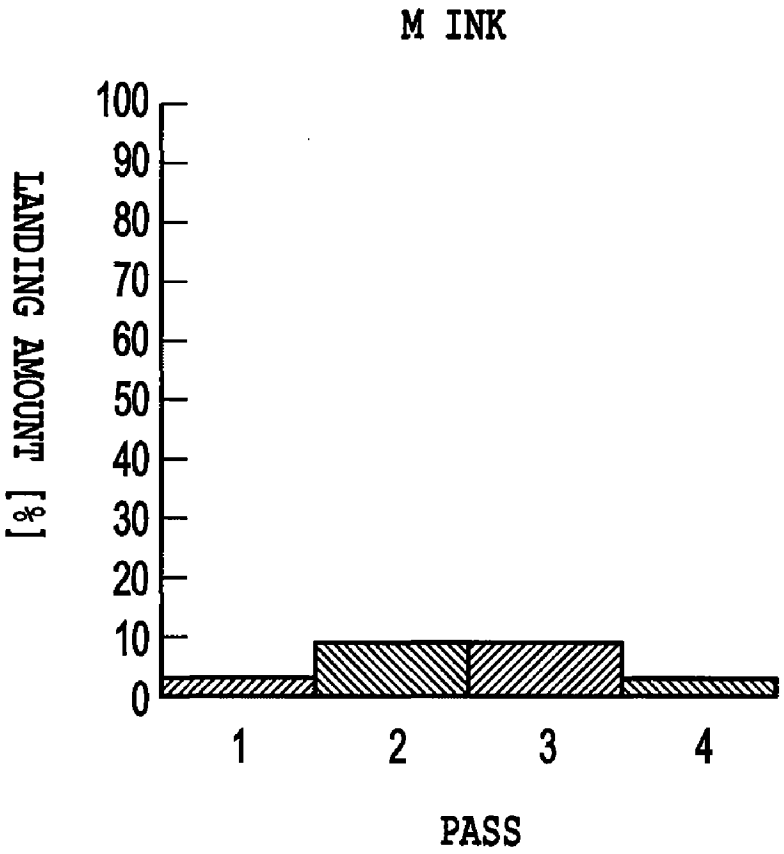
FIGS. 11A and 11B are graphs showing ink applying amounts in the respective passes when the masks according to the one conventional example are used.
Figure 11A:
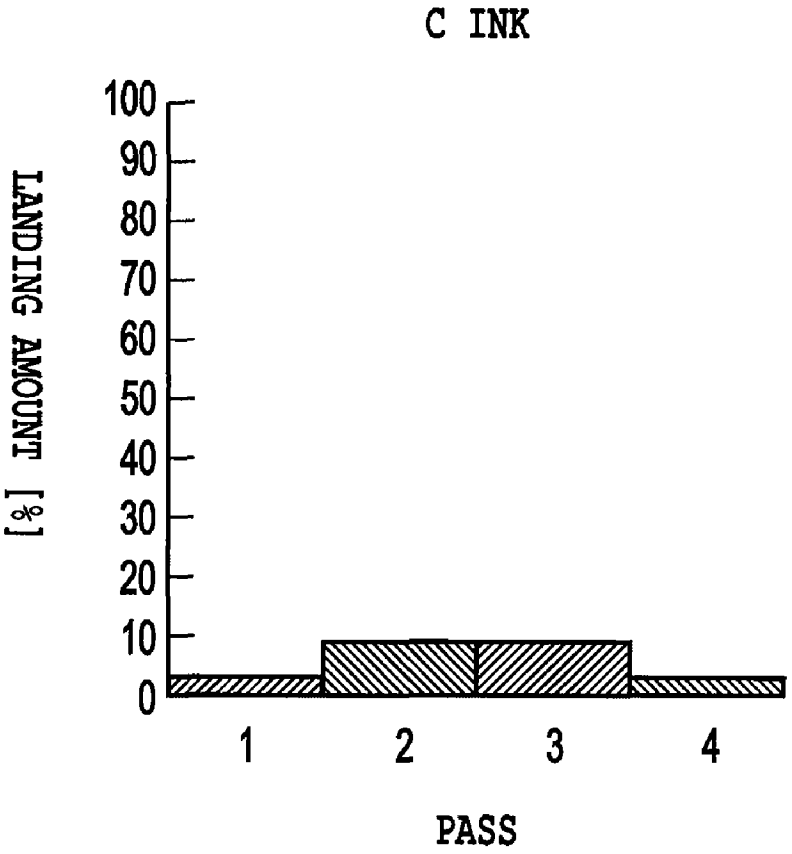

The case 3 is a case in which the C and M two color inks are equally used but is used in little amounts for printing. Since a total ink applying amount is minimal in this way, the same masks in the case 1 are used for both of the C and M inks in order to satisfactorily exhibit the advantageous effects of the conventional multi-pass printing or gradation masks in the same way as in the case 1. As a result, applying amounts per unit area in the respective passes are as shown in FIGS. 11A and 11B.

As described above, in the present embodiment, used masks are changed into the above described characteristic masks of the present embodiment from masks used in a case that the ink applying amount does not satisfy a predetermined condition, only in a case that the ink applying amount to a predetermined area satisfies the predetermined condition, as described in the judgment of step 702.

Note that, for ease of explanation, the example in which the C and M two color inks are used has been shown in the above description. However, as a matter of course, the present invention is not limited to this embodiment. For example, in a case in which four color inks of C, M, Y, and K are used, a high and low relationship of the P/B values of the four inks is determined. Then, a larger amount of an ink with a lower P/B value is to be applied in a later pass. That is, when masks are used, a print permitting ratio of a mask in a later pass of an ink with a lower P/B value among the masks for the four inks is made higher.

Further, in the above-described embodiment, applying amounts in the respective passes of the respective inks are to be determined by use of the masks. However, as a matter of course, this is not limited to the embodiment. For example, in a case in which four-pass multipass printing is performed by use of C and M inks, processing for dividing binary data into eight planes of the four passes of the respective color inks in accordance with the respective print permitting ratios of the respective masks in the respective passes of the respective colors described above, may be executed to determine applying amounts for the respective planes.

Second Embodiment

In a second embodiment of the present invention, for example, in a case in which the C and M inks which are the same as in the first embodiment are used to be applied so as to be overlapped on each other, since a permeation speed of the (M) ink applied later is slower in a case in which the M ink is overlapped on the C ink, this overlapping order is made less.

Hereinafter, an example in which the C and M inks having the same components as those in the first embodiment will be described. That is, a case in which a P/B value of the C ink is 2 and a P/B value of the M ink is 3, and a relationship of VCM<VMC is established will be described.

Figure 12A:
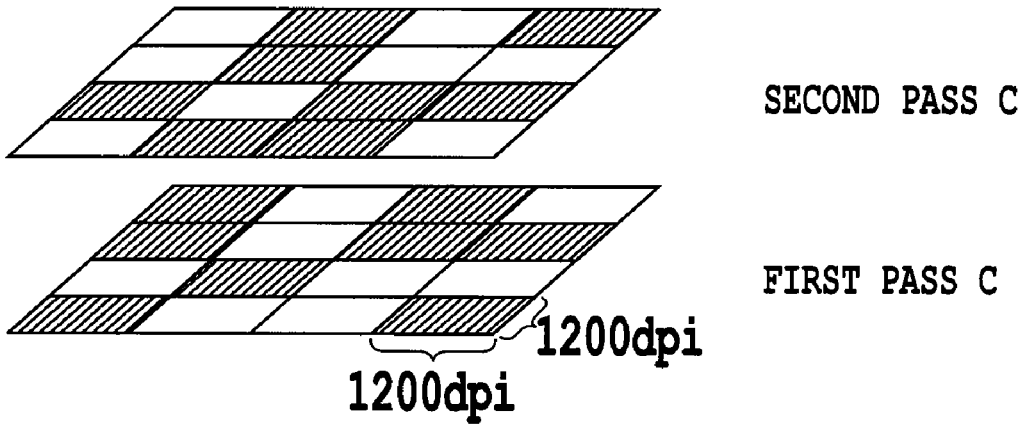
FIGS. 12A and 12B are diagrams showing masks for two-pass multi-pass printing according to one conventional example.
Figure 12B:
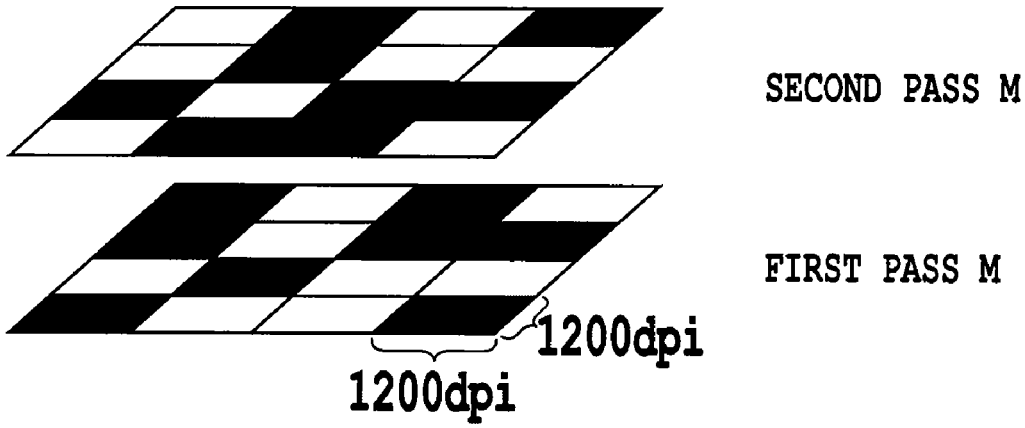

FIGS. 12A and 12B are diagrams showing masks for two-pass multi-pass printing according to one conventional example. That is, FIG. 12A shows the respective masks in the first pass and the second pass of the C ink, and FIG. 12B shows the respective masks in the first pass and the second pass of the M ink. As is clear from these diagrams, the masks for the C and M inks have the same mask (elements) patterns respectively having the same print permitting ratios in the first pass and the second pass. Accordingly, in a case in which an image in which the applying amounts of the C and M inks are respectively 100% is printed, the number of pixels on which the C ink is overlapped on the M ink and the number of pixels on which the M ink is overlapped on the C ink are the same, and the number of pixels respectively become 50% of the above-described image.

Figure 13:
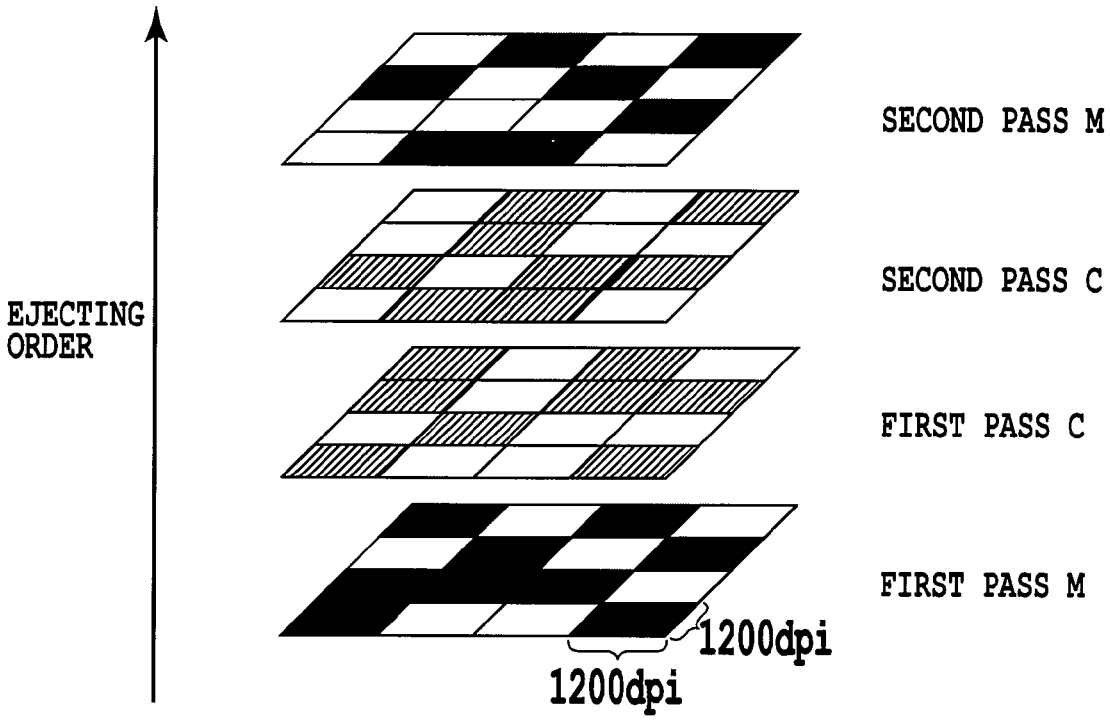
FIG. 13 is a diagram showing masks for two-pass multi-pass printing according to a second embodiment of the present invention.

FIG. 13 is a diagram showing masks for two-pass multi-pass printing according to the second embodiment of the present invention. Also, FIG. 13 expresses patterns of ink dots formed in the respective passes in a case of image data in which respective applying amounts of the C and M inks become 100%.

In FIG. 13, the print permitting ratio of the mask in the first pass of the M ink is 56.25%, and the print permitting ratio of the mask in the second pass is 43.75%. On the other hand, the print permitting ratios of the masks in both of the first pass and the second pass of the C ink are 50%. In this way, in the present embodiment as well, the condition of "the center of gravity of the print permitting ratios of the C ink mask is located in a later pass than that in which the center of gravity of the print permitting ratios of the M ink mask is located" that is described above in the first embodiment, is established.

By using the above-described masks in the present embodiment, in a case of an image in which the respective applying amounts of the C and M inks per unit area are 100%, pixels overlapping thereon among the pixels to which the C ink and the M ink are applied comprise 100%. Then, pixels to which the C ink is applied (in the first pass and the second pass) so as to be overlapped on the M ink comprise 56.25% of all the pixels, and pixels to which the M ink is applied (in the first pass and the second pass) so as to be overlapped on the C ink comprise 43.75% of all the pixels. As a result, it is possible to lower a probability that the C ink functioning to "reduce a permeation speed of an ink applied later by filling" more than the M ink is applied prior to the M ink, and to prevent beading.

Note that, as described above, in a case in which two-pass multipass printing is performed by use of the C and M inks in place of the use of masks, processing for dividing the binary data into four planes of two color inks and two passes in accordance with a predetermined print permitting ratio of each plane, may be executed. At this time, the binary data are divided such that the C ink is applied in a later pass to pixels on which the C and M inks are overlapped on each other. FIG. 14 is a flowchart of one example of the processing. As shown in the chart, when it is judged that the image data in a unit area requires use of inks whose permeation speeds are different from each other in step 1402, pixels on which inks with different permeation speeds are overlapped on each other are extracted. Then, for the pixels on which the inks are overlapped on each other, the binary data are divided such that an ink that makes a permeation speed of an ink applied later slow is applied in as late a pass as possible in accordance with the high and low of the permeation speeds (in step 1405). In this example, the binary data are divided such that the C ink is applied in a later pass than the M ink.

Third Embodiment

A third embodiment of the present invention relates to a mode in which printing is performed for a unit area By eight-pass multi-pass printing by use of two different black (K) inks including color materials of two different carbon blacks serving as pigment color materials. That is, in the present embodiment, these two K inks have different DBP oil absorption amounts, and an amount of an ink with a low DBP oil absorption amount (hereinafter K ink A) to be applied in a later pass is greater than an amount of an ink with a high DBP oil absorption amount (hereinafter K ink B). The components of the two K inks are as follows.

| K ink A (P/B value = 4) | |
|---|---|
| Pigment (DBP oil absorption amount = 114 [ml/100 g]) | 2% |
| Styrene acrylate | 0.5% |
| Glycerin | 20% |
| Acetylenol | 1% |
| Water | Remaining % |
| **K ink B (P/B value = 4)** | |
| Pigment (DBP oil absorption amount = 50 [ml/100 g]) | 2% |
| Styrene acrylate | 0.5% |
| Glycerin | 20% |
| Acetylenol | 1% |
| Water | Remaining % |

In the present example, in black image data, a maximum applying amount becomes 200% in total of the K ink A with a high DBP oil absorption amount of 100% and the K ink B with a low DBP oil absorption amount of 100%. The image data is printed by eight-pass multi-pass printing by-directional scans. Here, the applying amount of 100% means an amount in which four ink droplets of 4.5 pico-liters are applied to a pixel corresponding to 600 dpi×600 dpi. That is, in the same way as described above, one ink droplet is applied to a pixel corresponding to 1200 dpi×1200 dpi. That is, in a case of the above-described maximum applying amount, the K ink A and the K ink B are applied to all the pixels.

Figure 15:
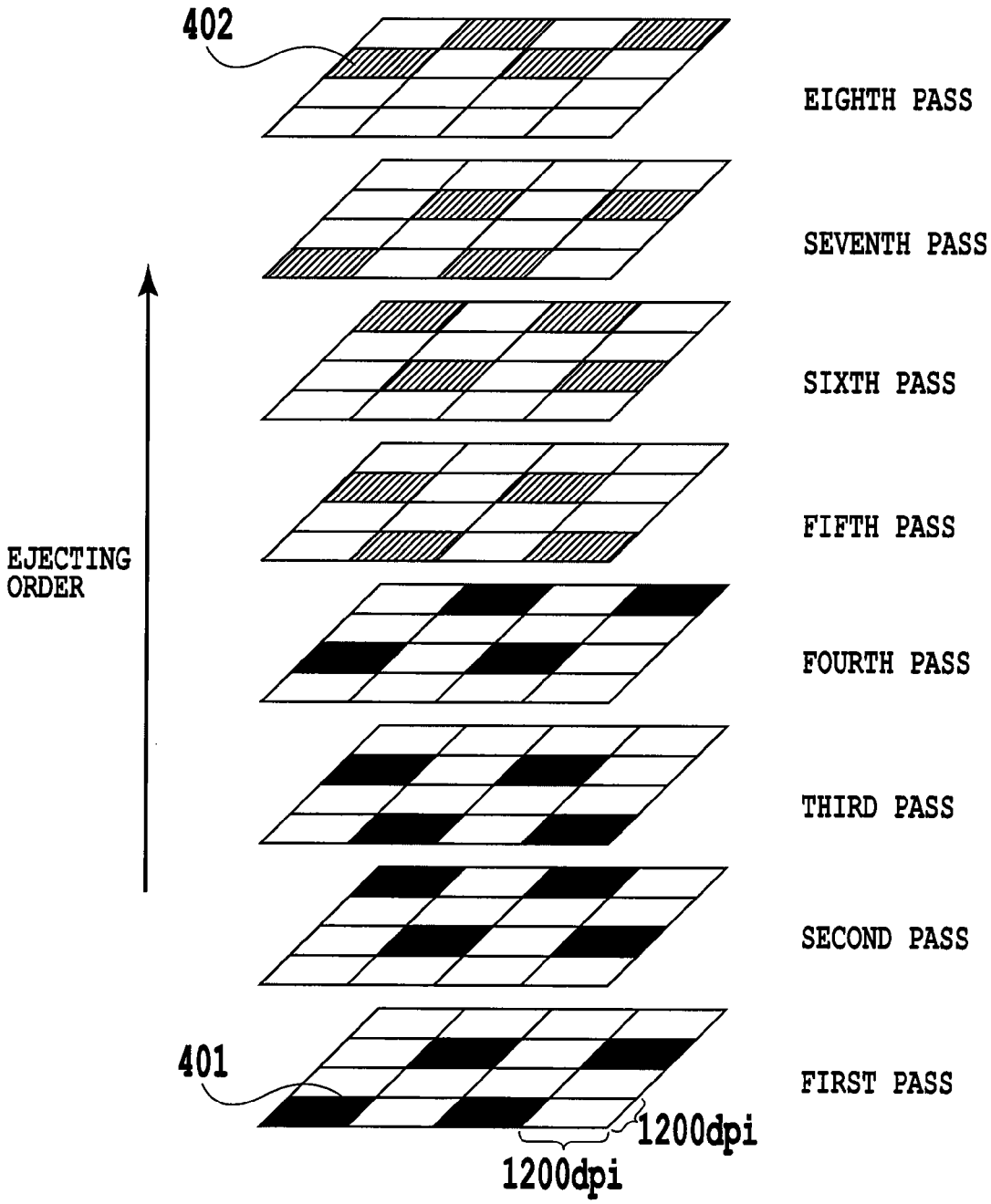
FIG. 15 is a diagram showing mask patterns, for which print permitting ratios are determined for the respective passes, of respective two black inks used in a third embodiment of the present invention.

FIG. 15 is a diagram showing masks (element patterns), for which print permitting ratios are determined for the respective passes, of the K ink A and the K ink B used in the present embodiment.

In FIG. 15, through the masks for the K ink A with a high DBP oil absorption amount, the ink is applied all the pixels in the unit area in the first four passes (the first to fourth passes) (mask elements 401). On the other hand, through the masks for the K ink B with a low DBP oil absorption amount, the ink is applied to all the pixels in the unit area in the four passes on and after the fifth pass (the fifth to eighth passes) (mask elements 402).

Thereby, the K ink A with a high DBP oil absorption amount is applied to all the pixels prior to the K ink B with a low DBP oil absorption amount. That is, a percentage of the number of pixels to which the K ink A with a high DBP oil absorption amount is applied to a printing medium prior to the K ink B with a low DBP oil absorption amount with respect to the total number of pixels to which the K ink A with a high DBP oil absorption amount is applied is 100%. On the other hand, a percentage of the number of pixels to which the K ink B with a low DBP oil absorption amount is applied prior to the K ink A with a high DBP oil absorption amount is 0%. As a result, it is possible to eliminate the possibility that the K ink B with a low DBP oil absorption amount functioning to "reduce a permeation speed of an ink applied later by filling" slows down a permeation speed of the K ink A applied later, which makes it possible to prevent beading due to slowing down of a permeation speed.

Fourth Embodiment

In a fourth embodiment of the present invention, printing is performed such that the center of gravity of the print permitting ratios of an ink with a lower P/B value among three inks with different P/B values is located in a relatively later pass in the same way as in the first embodiment. In the following description, three types of Y, C, and M inks having the following components and P/B values are used.

| Y ink (P/B value = 1.5) | |
|---|---|
| Pigment | 3% |
| Styrene acrylate | 2% |
| Glycerin | 20% |
| Acetylenol EH | 20% |
| Water | Remaining % |
| C ink (P/B value = 2) | |
| Pigment | 2% |
| Styrene acrylate | 1% |
| Glycerin | 20% |
| Acetylenol EH | 1% |
| Water | Remaining % |
| M ink (P/B value = 3) | |
| Pigment | 3% |
| Styrene acrylate | 1% |
| Glycerin | 20% |
| Acetylenol EH | 1% |
| Water | Remaining % |

Further, this example is a case in which four-pass multipass printing is performed bi-directionally for printing head scanning.

As described above, the P/B values of the respective Y, C, and M inks are in a relationship of the Y ink<the C ink<the M ink, and the permeation speeds for a printing medium are in the same relationship. That is, the relationships of the permeation speeds are VYC<VCY, VYM<VMY, and VCM<VMC. Accordingly, in the present embodiment, print permitting ratios determined for the respective passes according to the above-described relationships are made different from each other with respect to the respective Y, C, and M inks. In detail, the masks are set as follows.

Figure 16A:
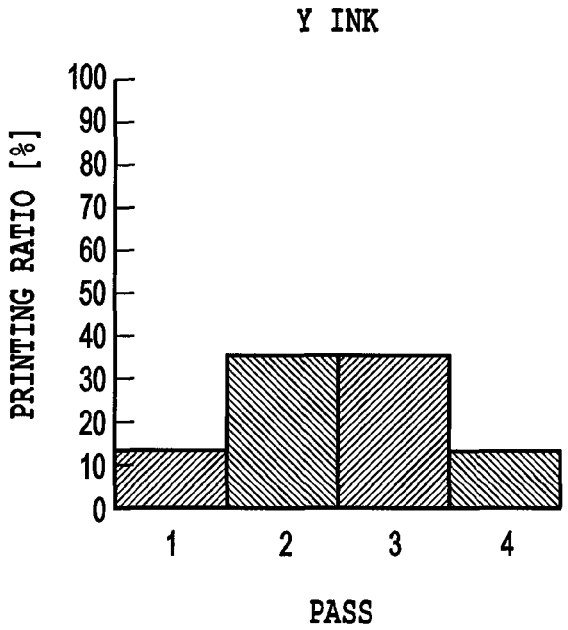
FIGS. 16A to 16C are graphs showing masks in one conventional example for comparison.
Figure 16B:
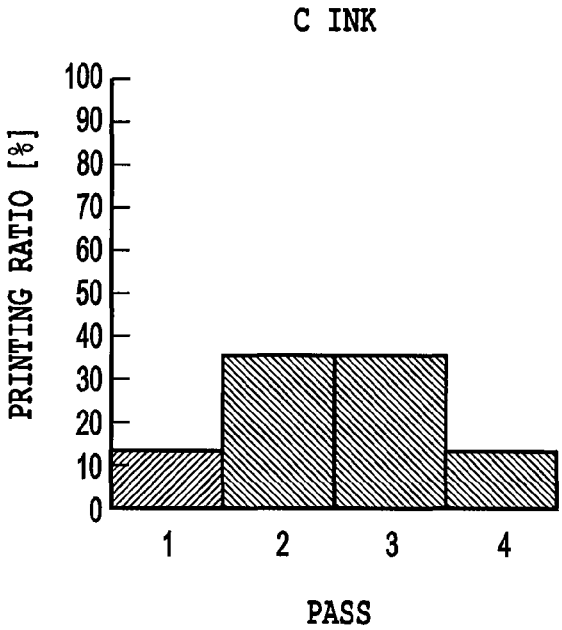
Figure 16C:
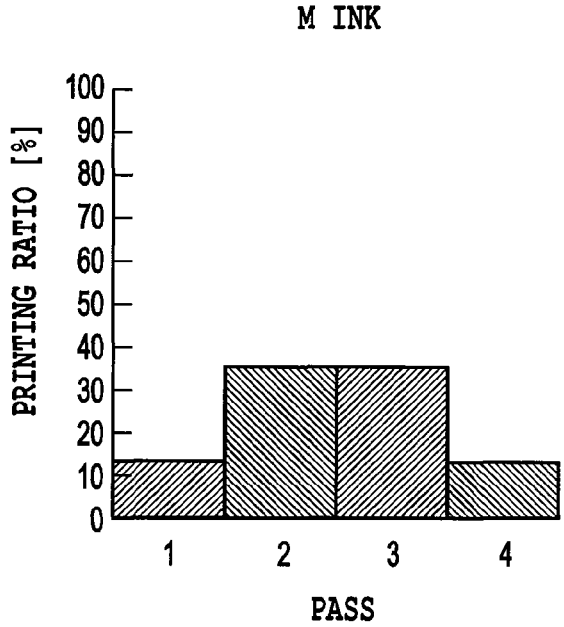

FIGS. 16A to 16C are graphs showing masks in one conventional example for comparison. As shown in these graphs, the print permitting ratios in the respective passes of the respective color inks are the same, and all the print permitting ratios are symmetric with respect to the passes. Therefore, a relationship among the centers of gravity of the print permitting ratios with respect to the passes of the Y ink, the C ink, and the M ink is;

$$\Sigma(n\times fY1(n))/\Sigma fY1(n))=\Sigma(n\times fC1(n))/\Sigma fC1(n)=\Sigma(n\times fM1(n))/\Sigma fM1(n).$$

Usually, $\Sigma fY1(n)=\Sigma fC1(n)=\Sigma fM1(n)=100\%$, and therefore, the relationship can also be expressed by;

$$\Sigma(n\times fY1(n))=\Sigma(n\times fC1(n))=\Sigma(n\times fM1(n)).$$

Figure 17A:
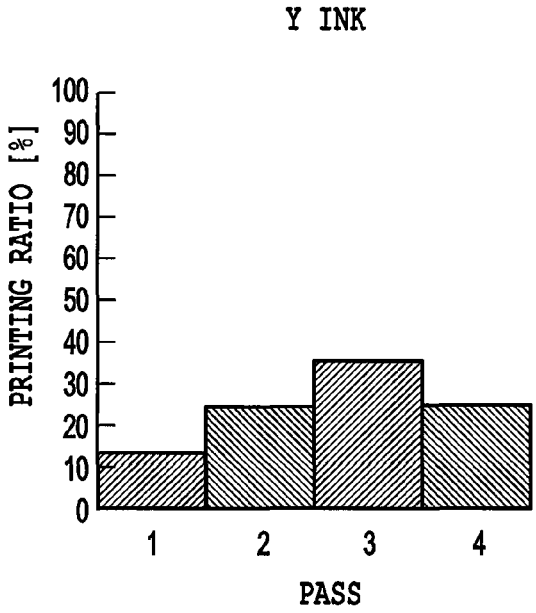
FIGS. 17A to 17C are graphs showing print permitting ratios in the respective passes of masks for the respective color inks according to a fourth embodiment of the present invention.
Figure 17B:
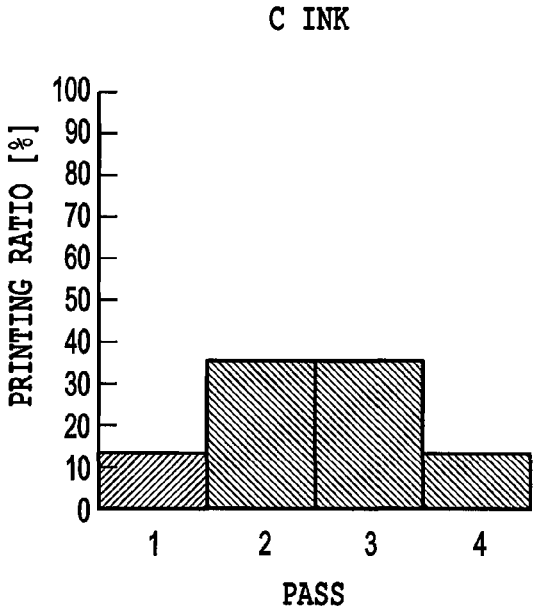
Figure 17C:
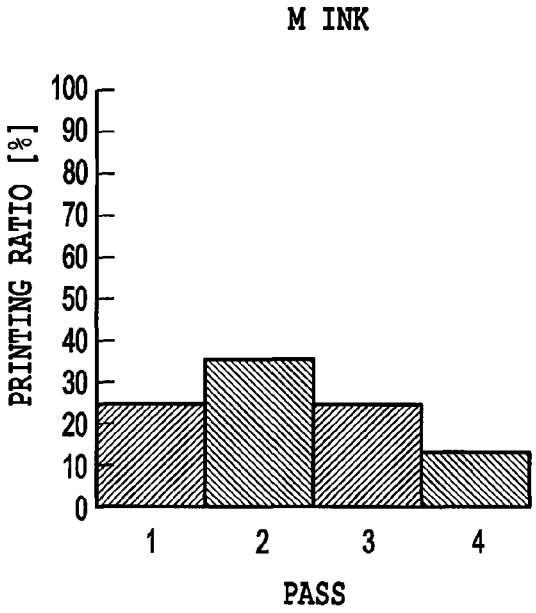

On the other hand, FIGS. 17A to 17C are graphs showing print permitting ratios in the respective passes of the masks for the respective color inks according to the present embodiment.

In the first to fourth passes, the print permitting ratios of the masks for the Y ink are respectively 12.5%, 25.0%, 37.5%, and 25.0%, and the print permitting ratios of the masks for the C ink are respectively 12.5%, 37.5%, 37.5%, and 12.5%, and the print permitting ratios of the masks for the M ink are respectively 25.0%, 37.5%, 25.0%, and 12.5%. In this case, relationships among the centers of gravity of the print permitting ratios with respect to the passes of the Y ink, the C ink, and the M ink are;

$$\Sigma(n\times fY2(n))/\Sigma fY2(n)>\Sigma(n\times fC2(n))/\Sigma fC2(n),$$

$$\Sigma(n\times fY2(n))/\Sigma fY2(n)>\Sigma(n\times fM2(n))/\Sigma fM2(n), \text{ and}$$

$$\Sigma(n\times fC2(n))/\Sigma fC2(n)>\Sigma(n\times fM2(n))/\Sigma fM2(n).$$

Here, in a case of $\Sigma fY2(n)=\Sigma fC2(n)=\Sigma fM2(n)=100\%$, the relationship can also be expressed by;

$$\Sigma(n\times fY2(n))>\Sigma(n\times fC2(n)),$$

$$\Sigma(n\times fY2(n))>\Sigma(n\times fM2(n)), \text{ and}$$

$$\Sigma(n\times fC2(n))>\Sigma(n\times fM2(n)).$$

Figure 18:
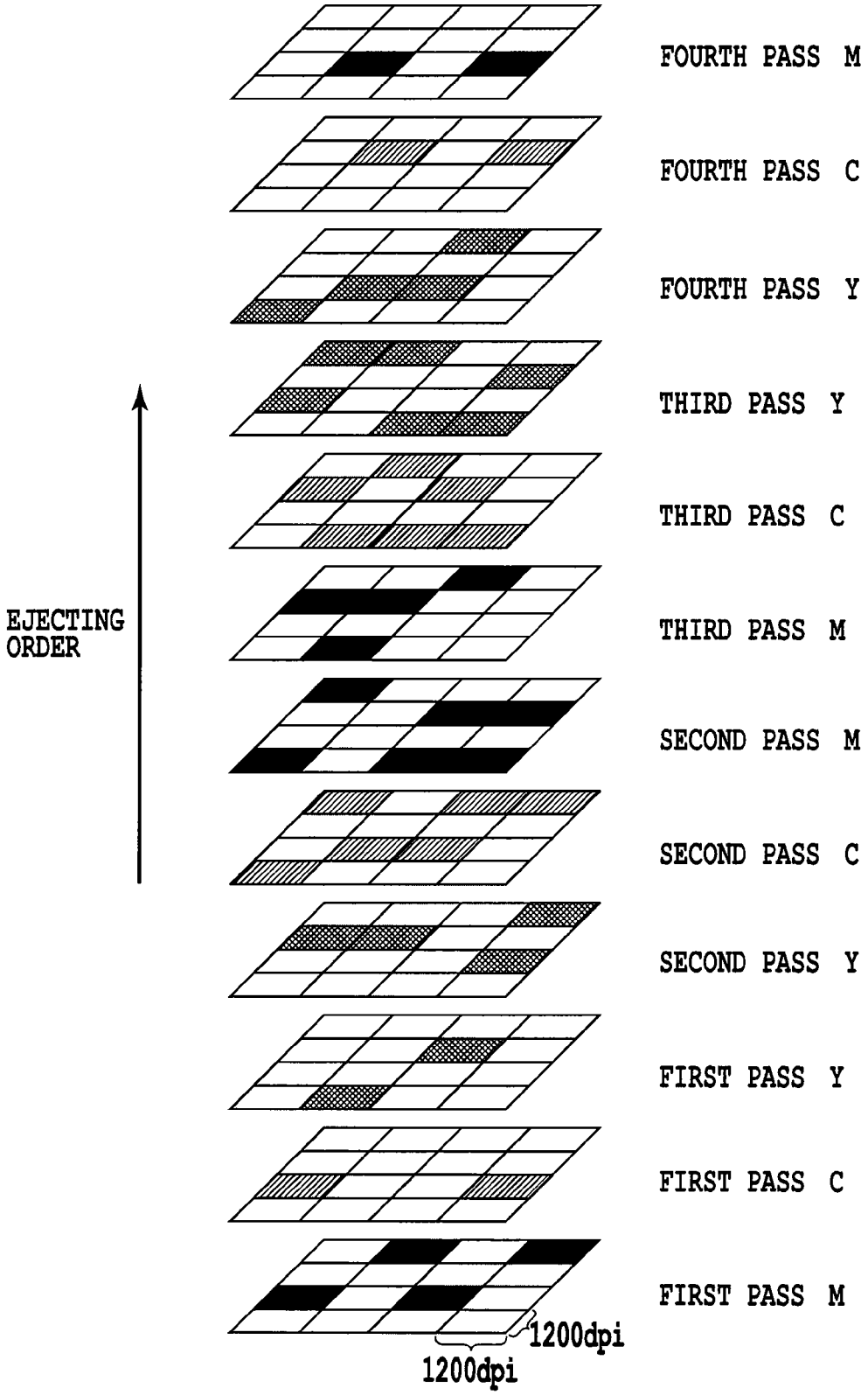
FIG. 18 is a diagram showing mask patterns in the fourth embodiment.

FIG. 18 is a diagram showing the masks in the present embodiment as patterns of mask elements, and also shows patterns of ink dots formed in the respective passes in a case of image data in which respective applying amounts of the Y, C, and M inks become 100%. In this way, a larger amount of an ink with a lower P/B value is applied in a later pass in accordance with the P/B values of the respective Y, C, and M inks. Thereby, it is possible to increase an ink functioning to "reduce a permeation speed of an ink applied later by filling" to a greater extent in an amount to be applied in a later pass, which makes it possible to prevent beading.

Fifth Embodiment

Figure 19:
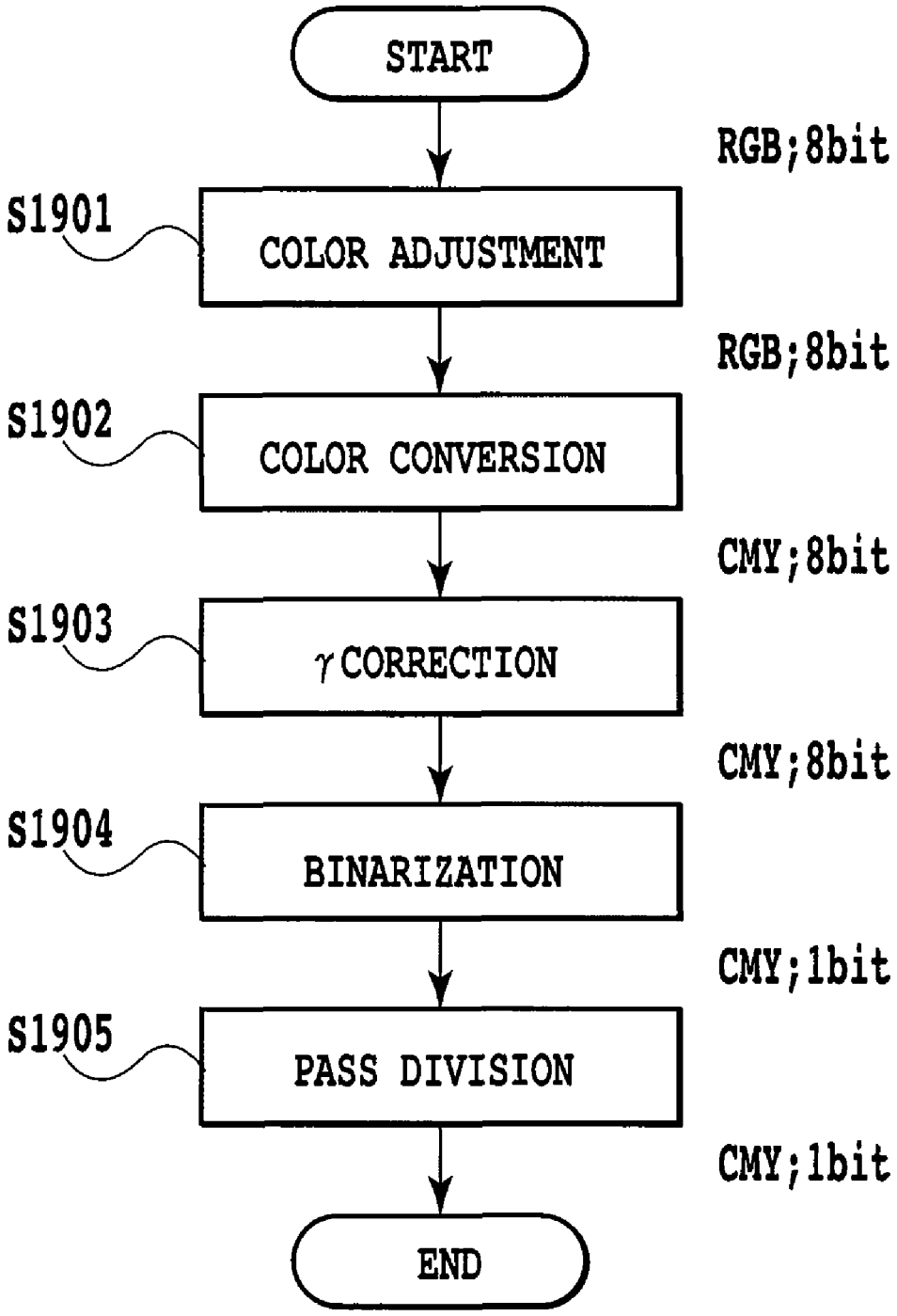
FIG. 19 is a flowchart showing processing in the first to fourth embodiments of the present invention.
Figure 20:
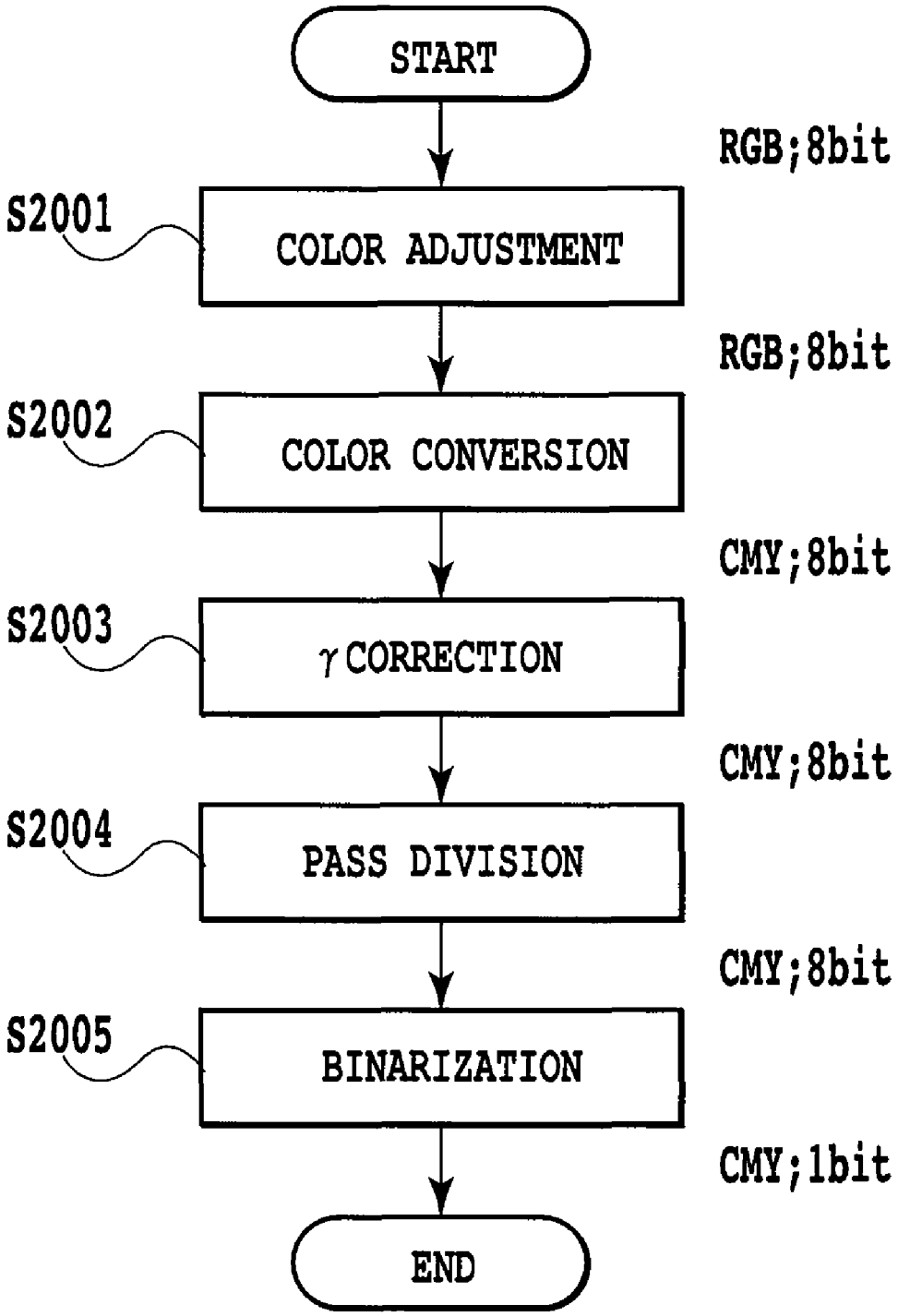
FIG. 20 is a flowchart showing processing in a fifth embodiment of the present invention.

The above-described first to fourth embodiments are processed in accordance with a flowchart shown in FIG. 19. That is, after binarization processing (S1904) is executed, processing for dividing the binary data into respective passes (S1905; pass division) is executed. However, the present invention can apply to other processings. As an example thereof, the present invention can apply to processing in which binarization (S2005) is executed after pass division (S2004) is executed in accordance with a flowchart shown in FIG. 20.

FIG. 21 is a flowchart for explaining binary (ejection) data generating processing in each pass according to the present embodiment. The processing shown in FIG. 21 is executed by the printer 104 in the present embodiment. Note that, a printing method is the same (four-pass multi-pass printing for bi-directional forward and backward scans).

First, after multivalued image data determined by output colors are acquired (S2101), it is judged whether or not the permeation speeds of the inks to be used are different from each other, and an ink applying amount per unit area is greater than or equal to the predetermined amount (S2102). When it is judged that the permeation speeds are different from each other (VCM<VMC), and the ink applying amount is greater than or equal to the predetermined amount, the processing shifts to step 2103. Then, pass division is carried out such that the C ink that makes a permeation speed slower is increased in an amount to be applied in a later pass among the four passes (S2104).

Figure 22:
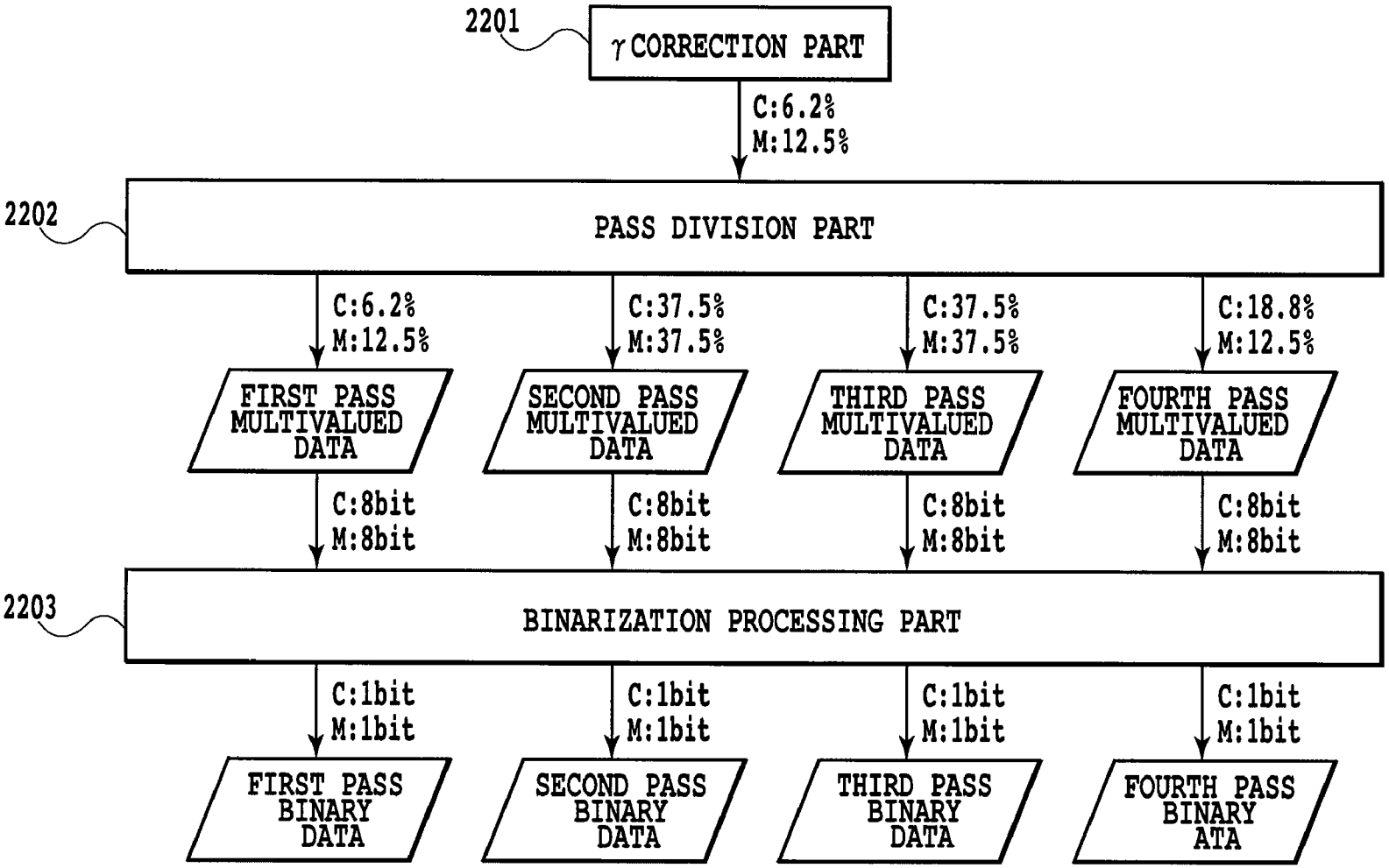
FIG. 22 is a block diagram showing details of the processing for pass division in the fifth embodiment.
Figure 23B:
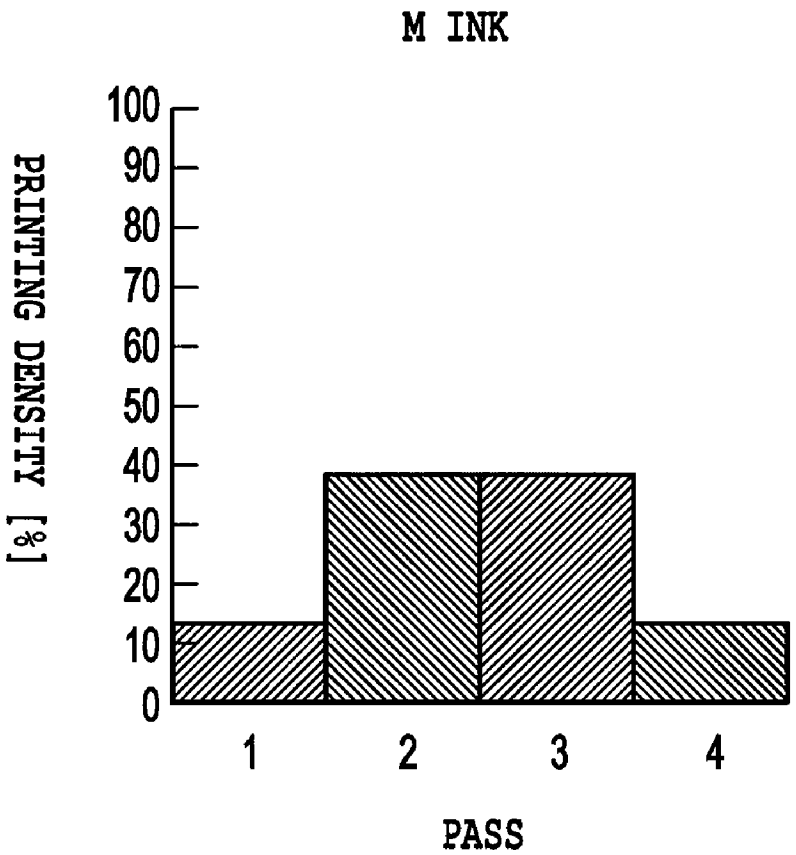
FIGS. 23A and 23B are graphs showing print densities in the respective passes of the respective colors in the processing for pass division in the fifth embodiment.
Figure 23A:
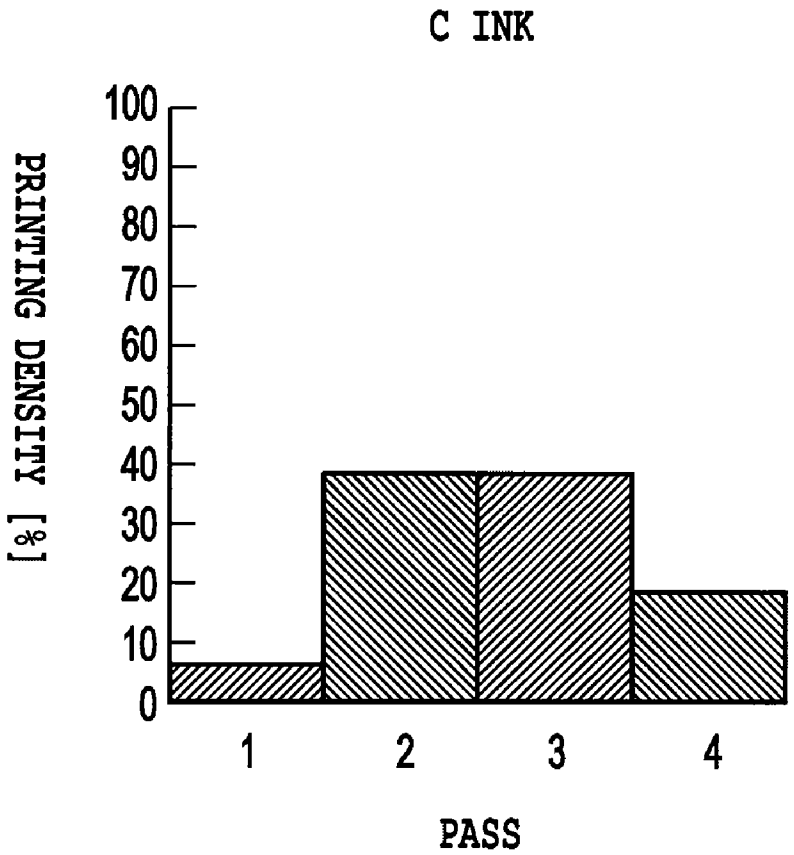

FIG. 22 is a diagram for explaining one concrete example the above processing. The respective applying amounts of the C ink and the M ink in the multivalued data are 100%. At the time of dividing the multi-valued data into four passes, the pass division is carried out so as to leave the multi-valued data as is such that the center of gravity of the print permitting ratios with respect to the passes of the C ink is located in a relatively later pass from that in which the center of gravity of the M ink is located. As an example, print densities (ink applying amounts) in the respective passes of the C ink and the M ink are shown in FIGS. 23A and 23B. The print densities in the first to fourth passes of the C ink are respectively 6.2%, 37.5%, 37.5%, and 18.8%, and the print densities in the first to fourth passes of the M ink are respectively 12.5%, 37.5%, 37.5%, and 12.5%.

As shown in FIG. 22, a pass division section 2202 multiplies the 8-bit data of the C ink on which a gamma-correction section 2201 has performed gamma correction (in step 2003 in FIG. 20) by percentages of 6.2%, 37.5%, 37.5%, and 18.8% respectively with respect to the first to fourth passes of the C ink, to acquire 8-bit data for the respective passes. In the same way, the pass division section 2202 multiplies the 8-bit data of the M ink by percentages of 12.5%, 37.5%, 37.5%, and 12.5% respectively with respect to the first to fourth passes of the M ink, to acquire 8-bit data for the respective passes. Then, a binarization processing section 2203 executes binarization processing for the data in the respective passes of the respective colors obtained in this way, to generate binary (ejection) data. Any known method may be used as this binarization technique. Further, a technique disclosed in Japanese Patent No. 4273175 by the present applicant may be used as such a binarization technique.

As described above, even in a system in which binarization processing is executed after pass division is executed, print densities in the respective passes can be set such that a larger amount of the C ink is applied in a later pass as compared with the M ink. Thereby, it is possible to reduce an amount of the M ink to be applied later with respect to the C ink functioning to "reduce a permeation speed of an ink applied later by filling," and it is possible to prevent a permeation speed from slowing down overall. As a result, it is possible to prevent the occurrence of beading due to a time to complete permeation becoming longer.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-166181, filed Jun. 25, 2008, which is hereby incorporated by reference herein in its entirety.

What is claimed is:

1. An ink jet printing apparatus that performs a relative movement of a first ejection portion for ejecting a first ink and a second ejection portion for ejecting a second ink, which is a different type of ink from the first ink, to a printing medium, and causes the first and second ejection portions to eject the first and second inks to print an image on the printing medium during the relative movement, wherein a permeation speed of the first ink in a case that the first ink is ejected on the second ink that has been ejected onto the printing medium is slower than a permeation speed of the second ink in a case that the second ink is ejected on the first ink that has been ejected onto the printing medium, and ejection timings of the first and second inks from the first and second ejection portions are controlled so that a percentage of pixels to which the second ink is ejected after the first ink is ejected is higher than a percentage of pixels to which the first ink is ejected after the second ink is ejected.

2. An ink jet printing apparatus that performs printing onto a printing medium by using a first ejection portion for ejecting a first ink and a second ejection portion for ejecting a second ink, which is a different type of ink from the first ink, said apparatus comprising:

a moving unit configured to perform a relative movement of the first and second ejection portions with respect to the printing medium;

a dividing unit configured to divide first image data to be printed on a predetermined area of the printing medium by using the first ejection portion into first divided image data groups corresponding to a plurality of relative movements and divide second image data to be printed on the predetermined area by using the second ejection portion into second divided image data groups corresponding to the plurality of relative movements; and an ejection controlling unit configured to cause the first ejection portion to eject the first ink according to the first divided image data groups and cause the second ejection portion to eject the second ink according to the second divided image data groups, during the plurality of relative movements for the predetermined area, wherein a permeation speed of the first ink in a case that the first ink is ejected on the second ink that has been ejected onto the printing medium is slower than a permeation speed of the second ink in a case that the second ink is ejected on the first ink that has been ejected onto the printing medium, and the dividing unit divides the first and second image data so that a percentage of pixels to which the second ink is ejected after the first ink is ejected is higher than a percentage of pixels to which the first ink is ejected after the second ink is ejected.

3. An ink jet printing apparatus that performs printing onto a printing medium by using a first ejection portion for ejecting a first ink and a second ejection portion for ejecting a second ink, which is a different type of ink from the first ink, said apparatus comprising:

a moving unit configured to perform a relative movement of the first and second ejection portions with respect to the printing medium;

a dividing unit configured to divide first image data to be printed on a predetermined area of the printing medium with use of the first ejection portion into first divided image data groups corresponding to a plurality of relative movements by using a first mask having print permitting ratios corresponding to the plurality of relative movements and divide second image data to be printed on the predetermined area with use of the second ejection portion into second divided image data groups corresponding to the plurality of relative movements by using a second mask having print permitting ratios corresponding to the plurality of relative movements; and an ejection controlling unit configured to cause the first ejection portion to eject the first ink according to the first divided image data groups and cause the second ejection portion to eject the second ink according to the second divided image data groups, during the plurality of relative movements for the predetermined area, wherein a permeation speed of the first ink in a case that the first ink is ejected on the second ink that has been ejected onto the printing medium is slower than a permeation speed of the second ink in a case that the second ink is ejected on the first ink that has been ejected onto the printing medium, and the print permitting ratio in the second mask corresponding to a last half of the plurality of relative movements is higher than the print permitting ratio in the first mask corresponding to a last half of the plurality of relative movements.

4. The ink jet printing apparatus as claimed in claim 3, wherein said dividing unit, when an ink applying amount to the predetermined area satisfies a predetermined condition, changes a mask used in a case that the ink applying amount does not satisfy the predetermined condition into the first and second masks for use.

5. An ink jet printing apparatus that performs printing onto a printing medium by using a first ejection portion for ejecting a first ink and a second ejection portion for ejecting a second ink, which is a different type of ink from the first ink, said apparatus comprising:

a moving unit configured to perform a relative movement of the first and second ejection portions with respect to the printing medium;

a dividing unit configured to divide first image data to be printed on a predetermined area of the printing medium with use of the first ejection portion into first divided image data groups corresponding to a plurality of relative movements by using a first mask having print permitting ratios corresponding to the plurality of relative movements and divide second image data to be printed on the predetermined area with use of the second ejection portion into second divided image data groups corresponding to the plurality of relative movements by using a second mask having print permitting ratios corresponding to the plurality of relative movements; and an ejection controlling unit configured to cause the first ejection portion to eject the first ink according to the first divided image data groups and cause the second ejection portion to eject the second ink according to the second divided image data groups, during the plurality of relative movements for the predetermined area, wherein a permeation speed of the first ink in a case that the first ink is ejected on the second ink that has been ejected onto the printing medium is slower than a permeation speed of the second ink in a case that the second ink is ejected on the first ink that has been ejected onto the printing medium, and the print permitting ratio in the second mask corresponding to the last relative movement of the plurality of relative movements is higher than the print permitting ratio in the first mask corresponding to the last relative movement of the plurality of relative movements.

6. An ink jet printing method of performing a relative movement of a first ejection portion for ejecting a first ink and a second ejection portion for ejecting a second ink, which is a different type of ink from the first ink, to a printing medium, and causes the first and second ejection portions to eject the first and second inks to print an image on the printing medium during the relative movement, wherein a permeation speed of the first ink in a case that the first ink is ejected on the second ink that has been ejected onto the printing medium is slower than a permeation speed of the second ink in a case that the second ink is ejected on the first ink that has been ejected onto the printing medium, and ejection timings of the first and second inks from the first and second ejection portions are controlled so that a percentage of pixel regions to which the second ink is ejected after the first ink is ejected is higher than a percentage of pixel regions to which the first ink is ejected after the second ink is ejected.

7. An ink jet printing method of performing printing onto a printing medium by using a first ejection a portion for ejecting a first ink and a second ejection portion for ejecting a second ink, which is a different type of ink from the first ink, said method comprising:

performing a relative movement of the first and second ejection portions with respect to the printing medium;

dividing first image data to be printed on a predetermined area of the printing medium by using the first ejection portion into first divided image data groups corresponding to a plurality of relative movements and dividing second imaged at a to be printed on the predetermined area by using the second ejection portion into second divided image data groups corresponding to the plurality of relative movements; and causing the first ejection portion to eject the first ink according to the first divided image data groups and causing the second ejection portion to eject the second ink according to the second divided image data groups, during the plurality of relative movements for the predetermined area, wherein a permeation speed of the first ink in a case that the first ink is ejected on the second ink that has been ejected onto the printing medium is slower than a permeation speed of the second ink in a case that the second ink is ejected on the first ink that has been ejected onto the printing medium, and the first and second image data are divided so that a percentage of pixels to which the second ink is ejected after the first ink is ejected is higher than a percentage of pixels to which the first ink is ejected after the second ink is ejected.

8. An ink jet printing method of performing printing onto a printing medium by using a first ejection portion for ejecting a first ink and a second ejection portion for ejecting a second ink, which is a different type of ink from the first ink, said method comprising:

performing a relative movement of the first and second ejection portions with respect to the printing medium;

dividing first image data to be printed on a predetermined area of the printing medium with use of the first ejection portion into first divided image data groups corresponding to a plurality of relative movements by using a first mask having print permitting ratios corresponding to the plurality of relative movements and dividing second image data to be printed on the predetermined area with use of the second ejection portion into second divided image data groups corresponding to the plurality of relative movements by using a second mask having print permitting ratios corresponding to the plurality of relative movements; and causing the first ejection portion to eject the first ink according to the first divided image data groups and causing the second ejection portion to eject the second ink according to the second divided image data groups, during the plurality of relative movements for the predetermined area, wherein a permeation speed of the first ink in a case that the first ink is ejected on the second ink that has been ejected onto the printing medium is slower than a permeation speed of the second ink in a case that the second ink is ejected on the first ink that has been ejected onto the printing medium, and the print permitting ratio in the second mask corresponding to a last half of the plurality of relative movements is higher than the print permitting ratio in the first mask corresponding to a last half of the plurality of relative movements.

9. An ink jet printing method of performing printing onto a printing medium by using a first ejection portion for ejecting a first ink and a second ejection portion for ejecting a second ink, which is a different type of ink from the first ink, said method comprising:

performing a relative movement of the first and second ejection portions with respect to the printing medium;

dividing first image data to be printed on a predetermined area of the printing medium with use of the first ejection portion into first divided image data groups corresponding to the plurality of relative movements by using a first mask having print permitting ratios corresponding to the plurality of relative movements and dividing second image data to be printed on the predetermined area with use of the second ejection portion into second divided image data groups corresponding to the plurality of relative movements by using a second mask having print permitting ratios corresponding to the plurality of relative movements; and causing the first ejection portion to eject the first ink according to the first divided image data groups and causing the second ejection portion to eject the second ink according to the second divided image data groups, during the plurality of relative movements for the predetermined area, wherein a permeation speed of the first ink in a case that the first ink is ejected on the second ink that has been ejected onto the printing medium is slower than a permeation speed of the second ink in a case that the second ink is ejected on the first ink that has been ejected onto the printing medium, and the print permitting ratio in the second mask corresponding to the last relative movement of the plurality of relative movements is higher than the print permitting ratio in the first mask corresponding to the last relative movement of the plurality of relative movements.

* * * * *